US005958187A

United States Patent [19]

Bhat et al.

[11] Patent Number: 5,958,187

[45] Date of Patent: Sep. 28, 1999

[54] PREWETTABLE HIGH SOFTNESS PAPER PRODUCT HAVING TEMPORARY WET STRENGTH

[75] Inventors: Dinesh M. Bhat, Neenah; Robert J. Marinack, Oshkosh; Henry S. Ostrowski, Appleton; Scott D. Moesch, Neenah, all of Wis.

[73] Assignee: Fort James Corporation, Deerfield, Ill.

[21] Appl. No.: 08/893,455

[22] Filed: Jul. 11, 1997

Related U.S. Application Data

[63] Continuation of application No. 08/401,690, Mar. 10, 1995, abandoned, which is a continuation-in-part of application No. 08/210,836, Mar. 18, 1994, abandoned.

[51] Int. Cl.[6] ..... D21H 23/00

[52] U.S. Cl. ..... 162/125; 162/127; 162/129; 162/130; 162/131; 162/158; 162/175; 162/179; 162/164.3; 162/164.6; 162/168.2; 162/168.3; 162/183; 162/112; 162/109

[58] Field of Search ..... 162/111, 112, 162/123, 129, 130, 131, 158, 175, 179, 164.6, 168.2, 183, 109, 125, 127, 164.3, 168.3, 113

[56] References Cited

U.S. PATENT DOCUMENTS

| | | | |
|---|---|---|---|
| 1,546,211 | 7/1925 | Dreyfus . | |
| 1,816,973 | 8/1931 | Kantorowicz . | |
| 1,857,263 | 5/1932 | Sponsel et al. . | |
| 2,203,492 | 6/1940 | Evans et al. . | |
| 2,285,490 | 6/1942 | Broderick . | |
| 2,322,888 | 6/1943 | Schwartz et al. . | |
| 2,436,076 | 2/1948 | Pfeffer, Jr. et al. . | |
| 2,622,960 | 12/1952 | Woods et al. . | |
| 2,826,514 | 3/1958 | Schroeder . | |
| 3,096,228 | 7/1963 | Day et al. | 162/111 |
| 3,301,746 | 1/1967 | Sanford et al. | 162/117 |
| 3,312,521 | 4/1967 | Stenner . | |
| 3,556,932 | 1/1971 | Coscia et al. . | |
| 3,556,933 | 1/1971 | Williams et al. . | |
| 3,597,313 | 8/1971 | Williams et al. . | |
| 3,753,826 | 8/1973 | Plummer . | |
| 3,755,220 | 8/1973 | Freimark et al. . | |
| 3,798,122 | 3/1974 | Appel et al. | 162/111 |
| 3,810,783 | 5/1974 | Bomball . | |
| 3,821,068 | 6/1974 | Shaw . | |
| 3,837,999 | 9/1974 | Chung | 162/111 |
| 3,918,903 | 11/1975 | Kullman et al. . | |
| 4,112,167 | 9/1978 | Dake et al. . | |
| 4,117,187 | 9/1978 | Adams et al. . | |
| 4,164,595 | 8/1979 | Adams et al. . | |
| 4,191,609 | 3/1980 | Trokhan . | |
| 4,233,411 | 11/1980 | Ballweber et al. . | |
| 4,269,603 | 5/1981 | Worth . | |
| 4,447,294 | 5/1984 | Osborn, III . | |
| 4,537,807 | 8/1985 | Chan et al. . | |
| 4,603,176 | 7/1986 | Bjorkquist et al. . | |
| 4,605,702 | 8/1986 | Guerro et al. . | |
| 4,625,029 | 11/1986 | Floyd et al. . | |
| 4,666,750 | 5/1987 | Hammer et al. . | |
| 4,675,394 | 6/1987 | Solarek et al. . | |
| 4,695,606 | 9/1987 | Floyd et al. . | |
| 4,703,116 | 10/1987 | Solarek et al. . | |
| 4,720,383 | 1/1988 | Drach et al. . | |
| 4,731,162 | 3/1988 | Solarek et al. . | |
| 4,741,804 | 5/1988 | Solarek et al. . | |
| 4,788,280 | 11/1988 | Billmers et al. . | |
| 4,804,769 | 2/1989 | Solarek et al. . | |
| 4,849,054 | 7/1989 | Klowak | 162/111 |
| 4,866,151 | 9/1989 | Tsai et al. . | |
| 4,981,557 | 1/1991 | Bjorkquist . | |
| 4,983,748 | 1/1991 | Tsai et al. . | |
| 5,008,344 | 4/1991 | Bjorkquist . | |
| 5,059,282 | 10/1991 | Ampulski et al. | 162/111 |
| 5,085,736 | 2/1992 | Bjorkquist . | |
| 5,138,002 | 8/1992 | Bjorkquist . | |
| 5,217,576 | 6/1993 | Van Phan | 162/111 |

(List continued on next page.)

FOREIGN PATENT DOCUMENTS

| | | |
|---|---|---|
| 1279145 | 6/1986 | Canada . |

OTHER PUBLICATIONS

Welch, Clark M., "Glyoxal as a Formaldehyde–Free Durable Press Reagent for Mild Curing Applications," Textile Research Journal, Mar. 1983, pp. 181–186.

Mattioda, G., et al., "What you can do with glyoxal," Chemtech, Aug. 1983, pp. 478–481.

Sangsari, Farid Hamedi, et al., "Competitve Hemiacetalization and Acetalization: Cross–Linking of Cellulose by Glyoxal," Recl. Trav. Chim., Pays–Bas 109, 419–424 (1990).

(List continued on next page.)

*Primary Examiner*—Peter Chin
*Attorney, Agent, or Firm*—Finnegan, Henderson, Farabow, Garrett, & Dunner L.L.P.

[57] ABSTRACT

A paper product and a method of making a paper product with a glabrous surface and adapted for use either dry or use in a manually pre-moistened condition. The paper product has temporary wet strength exhibiting an initial normalized CD wet tensile strength of at least about 25 g/1" strip, preferably 35 g/1" strip as measured by the Finch Cup Test 5 seconds after immersion and a subsequent CD wet tensile strength of less than about ⅔ the initial value as measured 30 minutes after immersion. A temporary wet strength agent comprising aldehydic units in the range of from about 2 pounds per ton to about 30 pounds per ton is added to the furnish. A cationic nitrogenous softener/debonder is preferably added to the furnish, in an amount of from about 1 pound per ton to about 6 pounds per ton. The CD dry tensile strength of the paper product is from at least about 133 g/1" up to about 267 g/1", and the tensile modulus is from about 10 to about 32 g/% strain while the GM MMD friction is from about 0.26 to about 0.10. Preferably, the wet strength of the product decays with sufficient speed that the CD wet tensile strength drops to about 15 g/1" strip within 10 hours after immersion. When rubbed against a skin-like surface in a moistened condition, the paper product remains substantially free of pilling.

95 Claims, 10 Drawing Sheets

U.S. PATENT DOCUMENTS

| | | | |
|---|---|---|---|
| 5,223,096 | 6/1993 | Phan et al. . | |
| 5,240,562 | 8/1993 | Phan et al. | 162/111 |
| 5,246,546 | 9/1993 | Ampulski . | |
| 5,262,007 | 11/1993 | Phan et al. . | |
| 5,330,622 | 7/1994 | Hemmerat et al. . | |
| 5,405,501 | 4/1995 | Phan et al. | 162/130 |

OTHER PUBLICATIONS

Sangsari, Farid Hamedi, et al., "The acetalization of glyoxal by vicinal diols," Recl. Trav. Chim., Pays–Bas 109, 15–20 (1990).

Bertoniere, Noelie R.I, et al., "Pore Structure of Cotton Fabrics Cross–Linked with Formaldehyde–Free Reagents," Textile Res. J., 349–356 (1992).

Shyu, Jyh–Pyng, "Properties of Cotton Fabrics Crosslinked with Different Molecular Chain Lengths of Aldehyde Agents," Textile Res. J. 62(8), 469–474 (1992).

Dialog Search, "Glyoxal or Formaldehyde as Crosslinking Agents," 73 items.

Guette, J.P., Glyoxal: A Very Useful Molecule (English Abstract of a French Article).

Hoke, Stephen et al., "A New Fugitive Wet Strength Resin," from 1985 Papermakers Conference, pp. 23–30.

"GLYOXAL", brochure published by Societe Francaise HOECHST, undated.

Hurwitz, Melvin D. et al., "Dialdehydes as Cotton Cellulose Cross–Linkers," Textile Research Journal, Mar. 1958, pp. 257–262.

Buttrick, G. W. et al., "Improving the Wet Rub Resistance of Starch–Clay Paper Coatings with Glyoxal," Tappi, vol. 45, No. 11, Nov. 1962, pp. 890–893.

Eldred, N.R., et al., "Glyoxal: A Unique Wet–Strength Agent," Tappi, vol. 46, No. 10, Oct. 1963, pp. 609–612.

Kleigman, Jonathan M., et al., "Glyoxal Derivatives. v. Reaction of Alcohol with Glyoxal," J. Org. Chem., vol. 38, No. 3, 1973, pp. 556–560.

Kleigman, Jonathan Mr., "Glyoxal Derivatives. VI. The Formation of Glycolates and the Acid–Catalyzed Decomposition of Glyoxal Acetals," J. Org. Chem. vol. 39, No. 12, 1974, pp. 1772–1776.

Welch, Clark M., et al., "Glyoxal as a Non–Nitrogenous Formaldehyde–Free Durable–press Reagent for Cotton," 1982 Textile Research Institute, Feb. 1982, pp. 149–157.

Yamamoto, Kazahide, "Crease–Resistance Treatments of Cotton Fabrics with Non–Formaldehyde Crosslinking Agents," 1982 Textile Research Institute, Jun. 1982, pp. 357–362.

PREWETTABLE HIGH SOFTNESS PAPER PRODUCT HAVING TEMPORARY WET STRENGTH

RELATED APPLICATION

This application is a continuation of application Ser. No. 08/401,690, filed Mar. 10, 1995, now abandoned; which, in turn, is a continuation in part of Ser. No. 08/210,836, filed Mar. 18, 1994 abandoned.

BACKGROUND OF THE INVENTION

Bathroom tissue must reconcile several conflicting properties: bath tissue must be strong, soft, flushable, dispersible and degradable. Even achieving desirable combinations of just these properties at an economically viable cost is a considerable challenge. However, even though a bathroom tissue which could be premoistened and used wet would provide significant new benefits to the user in regard to both extra cleaning and a feeling of freshness, no product currently on the market is really well suited to be used premoistened.

While at least one brand of commercially available bath tissue possesses some degree of wet strength, it appears that the manufacturer's purpose in including temporary wet strength in those products may be to counter the effects of wetting often occurring during normal use. When attempts are made to use these tissues after premoistening, the tissues "shred" and "pill" quite severely. Thus, rather than providing enhanced cleaning, attempted use of these products in a premoistened condition often leaves considerable detritus of shreds and pills of paper on the area that was to be cleaned, thereby largely defeating the purpose of attempting to use tissue premoistened.

However, adding resistance to wet abrasion as an additional conflicting required property to those previously mentioned poses an even tougher technical challenge. Construction of a tissue which has sufficient wet strength that it can be used premoistened inherently conflicts not only with flushability and dispersibility but also with retaining sufficient softness to be used either premoistened or dry. Nevertheless, the present invention provides a tissue which (i) has sufficient wet strength and resistance to wet abrasion that it can be used premoistened; (ii) is flushable; (iii) is dispersible and biodegradable; (iv) has dry strength comparable to premium bath tissue; and (v) has softness comparable to modern premium bath tissue.

The tissue of the present invention reconciles these conflicting objectives by providing a tissue having a glabrous surface coupled with an initial normalized temporary wet strength of at least about 24–25 g/in, preferably about 35 grams/inch as measured using the Finch Cup method for an 18.5 lb/3000 sq ft ream, the tissue exhibiting a wet-to-dry CD (Cross Direction) tensile strength ratio of at least about 18%, preferably over 20%. Temporary wet strength is provided by use of temporary wet strength resin while in many cases softener/debonder helps bring the wet-to-dry ratio into the desired range and prevent the dry strength of the tissue from being so excessive as to unduly degrade the perceived softness of the product.

Simply adding a quantity of temporary wet strength resins such as cationic aldehydic starches to conventional furnishes for tissue does not guarantee that the product will be well suited for use premoistened. The present inventors have found that unless the tissue has both a glabrous surface and a normalized CD wet tensile of at least about 25 g/in, preferably 35 g/in, as measured by the Finch Cup Test ("FCT") at a basis weight of about 18–19 lbs/3000 sq ft ream, the tissue will typically pill or shred when an attempt is made to use it premoistened.

We have found that once the absolute (not-normalized) CD wet tensile of each sheet drops to about 12 g/in or less, the sheet does not usually have sufficient integrity to survive normal use when wet even though the sheet may not pill if handled gingerly enough to avoid tearing the sheet. Throughout this application, where a normalized wet tensile strength is mentioned, it should be understood that the tensile strength is as determined using the Finch Cup procedure in which a 1 inch sample of converted ready-to-use product having a basis weight 18.5 lb/3000 sq ft ream, (single ply or multi-ply as the case may be) is clamped in a special fixture termed a Finch Cup, then immersed in demineralized water at neutral pH and tensile tested at the indicated time after immersion. For initial wet tensile strength, the measurement is conducted 5 seconds after water is added to the cup. We prefer use of this procedure as we have found that the results obtained using the Finch Cup Test ("FCT") are reasonably reproducible.

Since the critical factor with regard to formation of pills seems to be the degree and strength of the internal bonds between the fibers in the sheet, for basis weights other than 18.5 lb/3000 sq ft ream, the critical tensile strength values (25 g/in or 35 g/in and so forth, as the case may be) should be adjusted proportionally to the basis weight i.e., normalized. For example, a 9.25 lb/3000 sq ft ream sheet having a CD wet tensile of about 17.5 g/in will perform satisfactorily as the CD wet tensile is proportionally the same as a 18.5 lb/3000 sq ft ream sheet having a CD wet tensile of 35 g/in and, accordingly, the normalized CD wet tensile of this 9.25 lbs/3000 sq ft ream would be 35 g/in. This squares well with our experience in which single plies of 9.25 lbs/3000 sq ft ream tissue have been satisfactory at CD wet tensile strengths of 22 and 16 g/in, while single plies having a CD wet tensile of 12 g/in fail by shearing without leaving pills.

To ensure that the tissue product will be sufficiently flushable to avoid requiring an excessive number of flushes to clear the bowl, we prefer that the wet strength of tissues of the present invention decays rapidly, exhibiting a normalized cross direction wet tensile of less than about ⅔ the initial value when measured 30 minutes after immersion, and ultimately dropping to about 15 g/1" strip after immersion for over about 10 hours.

Simple addition of a temporary wet strength agent often produces a paper product that does not possess sufficient softness to be acceptable as a premium bathroom tissue for normal household use. To help bring the softness of the sheet into the premium or near premium range, we have found that it is desirable to vary the jet/wire ratio to make the sheet a little squarer than we normally use in production of wet pressed tissues. For example, in production of conventional wet press tissue, we normally control the jet to wire ratio so that the ratio of machine direction dry tensile strength to cross direction dry tensile strength of the basesheet (before converting and embossing) is about 2.5.

For tissues of the present invention, we prefer to use a jet to wire ratio producing a base sheet having ratio of MD dry tensile to CD dry tensile of less than about 2.2, more preferably from about 1.6 to 2.1, most preferably from about 1.8 to 1.9. Similarly, we prefer to impart slightly more crepe to the web than we would normally use. For example, in conventional tissue, we would normally impart about 18–20% crepe to the web as it is creped off of the Yankee. For the tissues of the present invention, we prefer to impart a crepe of at least about 22%, more preferably at least about 23–24%.

1. Field of the Invention

The present invention is directed to a soft, strong, flushable, dispersible and biodegradable paper product having temporary wet strength which may be premoistened before use and resists pilling and shredding when used premoistened.

2. Description of Background Art

In order to provide a household bathroom tissue which is acceptable to consumers, it is necessary to provide a soft tissue which has sufficient dry tensile strength for normal use. In addition, it is necessary that the tissue is sufficiently dispersible for flushing in reasonable quantities in typical household toilets while providing a tissue with sufficient degradability to be accommodated in septic systems. Conventional bathroom tissue does not possess sufficient resistance to wet abrasion to be suitable for use premoistened without tending to pill or shred as described above.

Permanent wet tensile strength would normally interfere with both the dispersibility and degradability of the product and thus prevent the tissue from being compatible with a septic system. In addition, permanent wet tensile strength can often interfere with the flushing of the tissue in a typical household toilet either by clogging the bowl or being retained within the pipeline connecting the house to the sewer thus causing clogging, particularly, if roots are present to some extent as is often the case in older homes.

Conventionally, wet tensile strength is obtained in a paper product by adding a permanent wet strength resin or agent, such as the polyamide epichlorohydrin resins sold by Hercules under the trademark Kymene®, to the paper furnish. At least two mechanisms have been postulated to account for the mechanism by which wet strength resins act. One holds that wet strength resins form covalent bonds between adjacent fibers while another holds that the wet strength resin places a layer over the hydrogen bonds formed between adjacent paper fibers and thus prevents water from breaking the hydrogen bonds. In a permanent wet strength product, the strengthening effect does not decay with time. Accordingly, paper products produced with permanent wet strength resins would not normally be acceptable for use in a conventional household toilet or for use with a septic system.

To provide temporary wet strength, specialized temporary wet strength resins are incorporated into a cellulosic web. The nature of the resin chosen does not seem to be particularly critical provided that it provides wet strength properties as described herein. Suitable products are usually water soluble polymers or monomers and oligomers capable of forming water soluble polymers. Typically, these resins are water soluble organic polymers comprising aldehydic units or alternatively aliphatic dialdehydes such as glyoxal and cationic units. It is thought that these polymers or aliphatic dialdehydes form hemiacetal linkages with the cellulose and that these hemiacetal linkages hydrolyze at a moderate rate when immersed in water, so tissues incorporating these resins have considerable initial wet strength but after only a few minutes, the wet strength drops to some suitably low value to make the tissue flushable. In practice, the initial wet strength of tissues made using these resins tends to increase moderately over the first several days subsequent to manufacture thereof. In our experience, wet strength tends to be fairly well leveled out within about a week after manufacture, so throughout this specification and claims, where we refer to wet strength, that wet strength should be understood to be wet strength as obtained after about a week of aging unless the context clearly indicates otherwise.

Usually, cleansing of the perineum and adjacent regions of the human body is performed with bathroom tissue in a dry condition. Dry tissue does not always cleanse these regions as thoroughly as may be desired. Some users would prefer to use a bidet to assist with the cleansing of these regions for a feeling of extra cleanliness. However, if an individual uses conventional bathroom tissue after the perineum and adjacent regions are thoroughly wet or proceeds to moisten the tissue prior to use of the tissue, known bath tissues, even those few brands having significant wet strength, have a tendency to pill.

Pilling is a phenomenon occurring during use wherein small balls of tissue cling either to the surface of the tissue or to the user, possibly leading the tissue to shred before cleaning is complete. Such a condition is not desirable to most users. One purpose of this invention is to provide a flushable, sewer and septic-compatible tissue product which may be moistened before use and still retain sufficient softness, strength and resistance to pilling to be used in cleaning.

SUMMARY OF THE INVENTION

The present invention provides a bathroom tissue which has sufficient integrity and strength, particularly wet strength, that the tissue may be used either dry or premoistened, as well as being usable for cleaning when the region to be cleaned is thoroughly wet. Thus, a user is provided with a bathroom tissue for use wet, premoistened or dry. In addition, such a tissue according to the present invention is preferably reasonably soft, at least approaching the softness of premium quality bath tissue. Necessarily, the tissue must be both flushable and degradable for compatibility with use in septic systems.

The preferred bathroom tissues of the present invention combines the following five attributes:

(i) sufficient wet strength and wet-structural-integrity to be usable for cleansing while moistened;

(ii) sufficient dry strength to be usable for cleansing while dry;

(iii) softness comparable to or at least approaching the softness of premium bathroom tissues;

(iv) sufficient dispersibility to be flushable in reasonable quantities in typical household toilets;

(v) sufficient degradability to be accommodated in septic systems.

Softness is not a directly measurable, unambiguous quantity but rather is somewhat subjective. The two most important components for predicting perceived softness are generally considered to be surface texture and tensile modulus sometimes referred to by others as: stiffness, or stiffness modulus, or tensile stiffness. See J. D. Bates "Softness Index: Fact or Mirage?," TAPPI, vol. 48, No. 4, pp 63A–64A, 1965. See also H. Hollmark, "Evaluation of Tissue Paper Softness", TAPPI, vol. 66, No. 2, pp 97–99, February, 1983, relating tensile stiffness and surface profile to perceived softness. Alternatively, surface texture can be evaluated by measuring geometric-mean mean-deviation (GM MMD) in the coefficient of friction using a Kawabata KES-SE Friction Tester.

The paper product of the present invention has a pleasing texture as indicated by the GM MMD of less than about 0.26 measured as described below and a tensile modulus of less than about 32 g/% strain, preferably less than 28 g/% strain, as determined by the procedure for measuring tensile strength as described herein except that the modulus recorded is the geometric mean of the slopes on the cross direction and machine direction load-strain curves from a load of 0 to 50 g/1" when a sample width of 1 inch is used. All tensile moduli referred to herein should be understood to be measured at a tensile load of 50 g/in and reported in g/% strain, % strain being dimensionless.

As illustrated in FIG. 7, in those cases in which tensile modulus is allowed to range as high as 32 g/% strain, GM MMD should be less than 0.23. In those cases in which tensile modulus is confined to the range under 28 g/% strain, GM MMD can be allowed to be as high as 0.26. In the more preferred embodiments, GM MMD should be less than 0.2 and tensile modulus less than 27 g/% strain, with GM MMD still more preferably less than 0.185 and tensile modulus less than 26 g/% strain.

It has been found that, so long as care is taken to provide a glabrous surface, tissues providing an acceptable balance among all five of the properties listed above may be formed by making tissue in the usual fashion but using a combination of commercially available temporary wet strength agents preferably water soluble aliphatic dialdehydes or commercially available water soluble organic polymers comprising aldehydic units and cationic units such as those based on waxy maize starch, and optionally, a cationic nitrogenous softener/debonder chosen from the group consisting of trivalent and tetravalent cationic organic nitrogen compounds incorporating long fatty acid chains, including imidazolines, amido amine salts, linear amine amides, tetravalent or quaternary ammonium salts and mixtures thereof, both the temporary wet strength resin and the softener preferably being supplied in the wet end of the papermaking machine.

A tissue of the present invention (i) has sufficient wet strength and resistance to wet abrasion that it can be used premoistened; (ii) is flushable; (iii) is dispersible and biodegradable; (iv) has dry strength comparable to premium bath tissue; and (v) has softness comparable to modern premium bath tissue.

Numerous aliphatic and polymeric aldehydes can suitably be utilized to obtain the tissue of the present invention, however, to reach the five parameters set forth above the tissue of the present invention is designed to have a glabrous surface coupled with an initial normalized temporary wet strength of at least about 24–25 g/in, preferably about 35 grams/inch as measured using the Finch Cup method for an 18.5 lb/3000 sq ft ream. The tissue exhibits a wet-to-dry CD (Cross Direction) tensile strength ratio of at least about 18%, preferably over 20%. Temporary wet strength is provided by use of temporary wet strength resin. Simply adding a quantity of temporary wet strength resins such as cationic aldehydic starches or aliphatic dialdehydes such as glyoxal to conventional furnishes for tissue does not guarantee that the product will be well suited for use premoistened. The present inventors have found that unless the tissue has both a glabrous surface and a normalized CD wet tensile of at least about 25 g/in, preferably 35 g/in, as measured by the Finch Cup Test ("FCT") at a basis weight of about 18–19 lbs/3000 sq ft ream, the tissue will typically pill or shred when an attempt is made to use it premoistened. We have found that once the absolute (not-normalized) CD wet tensile of each sheet drops to about 12 g/in or less, the sheet does not usually have sufficient integrity to survive normal use when wet even though the sheet may not pill if handled gingerly enough to avoid tearing the sheet. Suitable wet strength aliphatic and aromatic aldehydes include glyoxal, malonic dialdehyde, succinic dialdehyde, glutaraldehyde, dialdehyde starches, polymeric reaction products of monomers or polymers having aldehyde groups and nitrogen groups. Representative nitrogen containing polymers which can suitably be reacted with the aldehyde containing monomers or polymers include vinylamides, acrylamides and related nitrogen containing polymers. These polymers inpart a positive charge to the aldehyde containing reaction product.

Our novel tissue can suitably include polymers having non-nucleophilic water soluble nitrogen heterocyclic moieties in addition to aldehyde moieties. Representative resins of this type are:

A. Temporary wet strength polymers comprising aldehyde groups and having the formula:

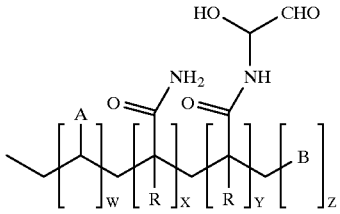

wherein A is a polar, non-nucleophilic unit which does not cause said resin polymer to become water-insoluble; B is a hydrophilic, cationic unit which imparts a positive charge to the resin polymer; each R is H, $C_1$–$C_4$ alkyl or halogen; wherein the mole percent of W is from about 58% to about 95%; the mole percent of X is from about 3% to about 65%; the mole percent of Y is from about 1% to about 20%; and the mole percent from Z is from about 1% to about 10%; said resin polymer having a molecular weight of from about 5,000 to about 200,000.

B. Water soluble cationic temporary wet strength polymers having aldehyde units which have molecular weights of from about 20,000 to about 200,000, and are of the formula:

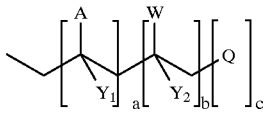

wherein: A is

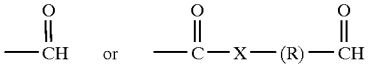

and X is —O—, —NH—, or —$NCH_3$— and R is a substituted or unsubstituted aliphatic group; $Y_1$ and $Y_2$ are independently —H, —$CH_3$, or a halogen, such as Cl or F; W is a nonnucleophilic, water-soluble nitrogen heterocyclic moiety; and Q is a cationic monomeric unit. The mole percent of "a" ranges from about 30% to about 70%, the mole percent of "b" ranges from about 30% to about 70%, and the mole percent of "c" ranges from about 1% to about 40%.

Polysaccharide aldehyde derivatives are suitable for use in the manufacture of our tissues. The polysaccharide aldehydes are disclosed in U.S. Pat. Nos. 4,983,748 and 4,675,394. These patents are incorporated by reference into this application. Suitable polysaccharide aldehydes have the following structure:

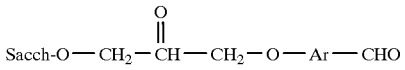

wherein Ar is an aryl group. Representative aldehyde cationic polysaccharides are disclosed in U.S. Pat. No. 4,788,280 and that patent is incorporated into this application by reference. The basic cationic dialdehyde moiety has the following structure:

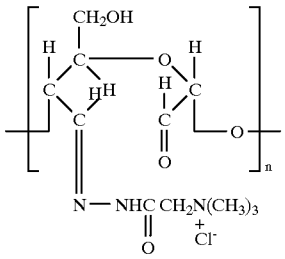

This cationic starch dialdehyde is a representative cationic aldehyde moiety suitable for use in the manufacture of our tissue.

Preferably, the temporary wet strength resin (starch) is supplied to a location, such as the suction side of the machine chest pump, in which it can react with the fiber before coming into contact with the softener/debonder while the softener/debonder, if supplied to an isolated location such as the stuff-box downleg, can therefore remain separated from the starch until the starch has had time to react. If the two are allowed to contact each other before, or simultaneously with, contacting the fiber; the effectiveness of each is diminished. In some cases, particularly in those case where nonpremium products are desired or where the product is meant to be a flushable towel, it is possible to obtain reasonable softness without use of the softener/debonder, but to obtain softness fully comparable to premium bath tissue, the softener/debonder is normally desirable.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2A is a photomicrograph taken at 20× of another tissue having a glabrous surface, Tissue W-1, made according to this invention as described in Example 1A and having an initial CD wet tensile of about 32 g/in.

FIG. 2B is a photomicrograph taken at 20× of another tissue having a marginally glabrous surface, Tissue X-1, made according as described in Example 1B and having an initial CD wet tensile of about 24 g/in.

FIG. 2C is a photomicrograph taken at 20X of another tissue having a marginally glabrous surface, Tissue Y-2, made according to this invention as adapted to follow the teachings of van Phan, U.S. Pat. Nos. 5,217,576 and 5,240,562 as described in Example 2 hereof and having an initial CD wet tensile of about 32 g/in.

DETAILED DESCRIPTION OF THE PREFERRED EMBODIMENTS

Figure 1:
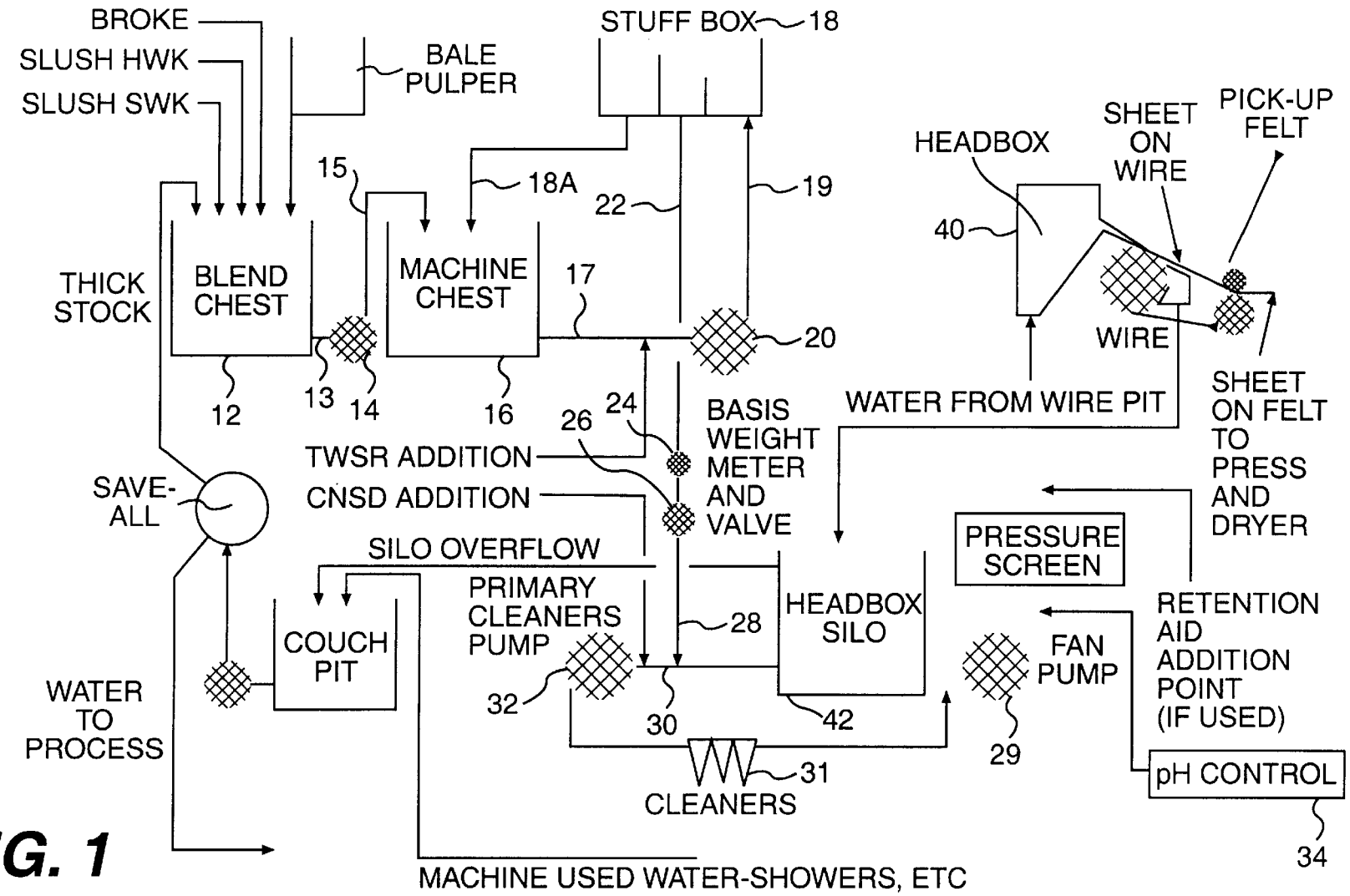
FIG. 1 is a schematic flow diagram of the furnish supply for a papermaking machine showing suitable points of addition of temporary wet strength resin and softener/debonder.

FIG. 1 illustrates a schematic supply system for preparing a furnish which is supplied to a headbox of a papermaking machine. A supply of softwood kraft and hardwood kraft are added to blend chest 12. The mixture of softwood kraft and hardwood kraft is pumped through conduits 13 and 15 by means of blend chest pump 14 to machine chest 16. In addition, excess furnish supplied to stuff box 18 is recycled back into machine chest 16 through conduit 18A.

A temporary wet strength agent which preferably includes an aldehydic group on cationic corn waxy hybrid starch is introduced at suction 17 of pump 20 as it draws from machine chest 16. For convenience, we will use the abbreviation "TWSR" for Temporary Wet Strength Resin throughout this specification to refer to such water soluble polymers. The temporary wet strength resin may be any one of a variety of water soluble organic polymers or monomers and oligomers capable of forming water soluable polymers comprising aldehydic units and cationic units used to increase the dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769; and 5,217,576. A particularly preferred temporary wet strength resin that may be used in practice of the present invention is a modified starch sold under the trademark Co-Bond® 1000 by National Starch and Chemical Company of Bridgewater, N.J. Prior to use, the cationic aldehydic water soluble polymer is prepared by preheating an aqueous slurry of approximately 5% solids maintained at a temperature of approximately 240° Fahrenheit and a pH of about 2.7 for approximately 3.5 minutes. Finally, the slurry is quenched and diluted by adding water to produce a mixture of approximately 1.0% solids at less than about 130° F.

Co-Bond® 1000 is a commercially available temporary wet strength resin including an aldehydic group on cationic corn waxy hybrid starch. It is theorized that the reactive groups are activated during acid cooking to provide a mixture capable of covalently bonding with cellulose presumably via hemi-acetal bonds which are moderately hydrolyzable so that the covalent bonds formed between the reactive groups and the cellulose are reversible. When the paper product is immersed in water, the bonds are broken as they hydrolyze and the wet strength decays. The hypothesized structure of the molecules are set forth as follows:

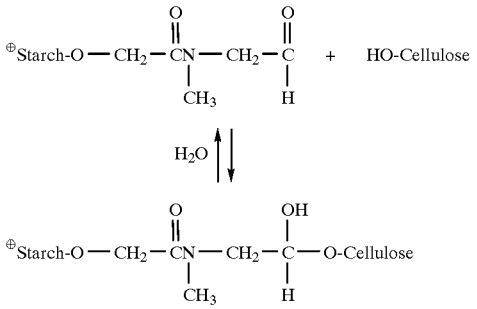

As mentioned, in use, it is theorized that a hemiacetal bond forms between the cellulose and the temporary wet strength resin, the hemiacetal bond being slowly hydrolyzable so that, upon contact with water, the sheet initially possesses the desired significant wet strength, but as the hemiacetal bonds hydrolyze during extended contact with water, the wet strength decays producing a paper product with temporary wet strength. Since the paper product has only temporary wet strength, the product can have enough wet strength to be usable if premoistened shortly before use but still also have sufficient dispersibility to be flushable in reasonable quantities in a typical household toilet along with sufficient degradability to be accommodated in a septic system.

We prefer to maintain some degree of segregation between the cationic aldehydic water soluble monomer or polymer and the cationic nitrogenous softener/debonder. If the paper machine can accommodate two separate furnishes, we can accomplish this by contacting a furnish comprising primarily softwood with cationic aldehyde monomer or polymer while a furnish comprising a greater percentage of hardwood would be contacted with cationic nitrogenous softener/debonder. In other cases, the cationic aldehydic monomer or polymer may be added to the furnish prior to addition of the cationic nitrogenous softener/debonder, allowing some intervening period for the cationic aldehydic monomer or polymer to interact with the furnish. Adding the cationic nitrogenous softener/debonder and cationic aldehydic monomer or polymer simultaneously lessens the effectiveness of each but usually produces a usable product albeit at somewhat greater cost than necessary.

Unfortunately, simply adding a quantity of this temporary wet strength aldehydic monomer or polymer to conventional furnishes for tissue neither guarantees that the product will be well suited for use premoistened nor does it guarantee that the product will possess sufficient softness to be acceptable as a premium bathroom tissue for normal household use.

Unless the tissue has both a glabrous surface and an initial normalized CD wet tensile of at least about 25 g/in, preferably 35 g/in, most preferably 45 g/in., as measured by the Finch Cup Test ("FCT"), the tissue will typically pill or shred when an attempt is made to use it premoistened. Both to avoid more serious plumbing problems and to ensure that the tissue product will be sufficiently flushable to avoid requiring an excessive number of flushes to clear the bowl, we prefer that the tissues of the present invention exhibit a normalized cross direction wet tensile decreasing to less than about 20 g/1" strip, more preferably less than about 15 g/1" strip.

Even if enough wet strength resin is added to bring the initial normalized CD wet tensile above 25 g/in, simple addition of a temporary wet strength agent does not guarantee that the tissue will not shred or pill if used premoistened. Typically, products made on through air drying equipment will not have a glabrous surface but rather will have the appearance of the brand Ch tissues illustrated in FIG. 3 which can be termed "crinose" or "non-glabrous". As demonstrated hereinafter, tissues having a crinose surface can have a normalized CD wet tensile well above 25 g/in and still pill or shred if an attempt is made to use them premoistened.

We have found that in most cases, tissues having significant wet strength (above about 25 g/in normalized CD wet tensile) produced using conventional wet pressing technology will exhibit a very smooth glabrous surface as compared to tissues made on through air drying equipment, particularly if the tissue is calendered or if it has been dewatered by a high level of uniform overall compaction or pressing such as occurs between two felts or as the web passes through a nip, particularly a nip including a suction pressure roll. For purposes of this invention, where there is doubt whether the surface of a tissue is glabrous as only a few small fibrils project from the surface, if that tissue (i) has a normalized FCT wet strength above 25 as described below, and (ii) will survive four wet rubs across moist pigskin without leaving pills on the pigskin, the surface should be considered glabrous. Tissues of the present invention may be manufactured in either multi-ply or single ply formats.

Normally, it is considered easiest to manufacture premium quality wet pressed tissues in the two ply format in which two lightweight plies are embossed together with the softer side of each ply facing outwardly but single ply products having the specified properties should be considered within the scope of the present invention and claims unless specifically excluded by the text of the specific claim in question.

The present invention utilizes machine chest pump 20 for supplying the furnish from machine chest 16 through conduits 17 and 19 to stuff box 18. A quantity of the furnish is supplied to conduit 22 through flow meter 24 for measuring the characteristics of the furnish. The basis weight of the furnish may be adjusted by control of basis weight valve 26. A quantity of a nitrogenous cationic softener/debonder is supplied to conduit 30 downstream of the basis weight valve 26. A nitrogenous cationic softener/debonder which may be used together with the present invention is Quasoft® 202-JR made by Quaker Chemical Corporation. Quasoft® 202-JR is a mixture of two major classes of cationic compounds derived from oleic acid and diethylenetriamine (DETA).

Linear Amineamides

I) di-amide

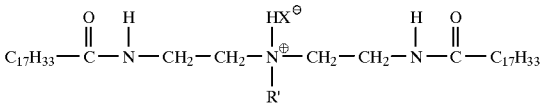

Imidazolines (Cyclic Amineamids)

II) di-amide derived

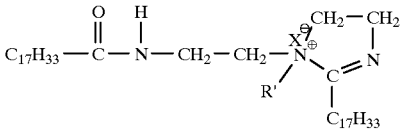

The Nitrogenous cationic softener/debonder is hypothesized to ionically attach to cellulose, reducing the number of sites available for hydrogen bonding thereby decreasing the extent of fiber-to-fiber bonding decreasing the dry strength more than the wet.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, Chemistry and Industry, Jul. 5, 1969, pp. 893–903; Egan, *J.Am. Oil Chemist's Soc.*, Vol. 55 (1978), pp. 118–121; and Trivedi et al., *J. Am. Oil Chemists' Soc.*, June 1981 pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used in practice.

Quasoft® 202-JR is a suitable softener material which may be derived by alkylating a condensation product of oleic acid and diethylenetriamine. Synthesis conditions using a deficiency of alkylating agent (e.g., diethyl sulfate) and only one alkylating step, followed by pH adjustment to protonate the non-ethylated species, result in a mixture consisting of cationic ethylated and cationic non-ethylated species. A minor proportion (e.g. about 10%) of the resulting amido amines cyclize to imidazoline compounds. Since only the imidazoline portions of these materials are quaternary ammonium compounds, the compositions as a whole are pH-sensitive. Therefore, in the practice of the present invention with this class of chemicals, the pH in the headbox should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 14–20 carbon atoms. These compounds have the advantage of being relatively insensitive to pH.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active basis, is preferably from about 0.5 pounds per ton of cellulose pulp up to about 10 pounds per ton of cellulose pulp. More preferred is from about 1 to about 5 pounds per ton, while from about 1 to about 3 pounds per ton is most preferred. In some cases, use of the non-quaternary compounds may lead to deposits in the plumbing of the paper machine. For this reason, the quaternary compounds are usually preferred.

It has been found that the accuracy of some basis weight metering and control systems can be adversely affected by presence of nitrogenous cationic softener/debonder in the furnish. Thus, the nitrogenous cationic softener/debonder should preferably be added downstream of flow meter 24 to avoid fluctuation in basis weight possibly resulting from the possible undesirable effect of nitrogenous cationic softener/debonder upon the accuracy of the measurements from flow meter 24.

Nitrogenous cationic softener/debonder provides a softening effect to permit the final paper product to have sufficient dry strength and wet strength to be used normally or premoistened yet remain soft enough to be acceptable for normal household use. The furnish with the water soluble cationic aldehydic polymer and the nitrogenous cationic softener/debonder is delivered through conduit 30 to primary cleaners pump 32. From primary cleaners pump 32, the furnish passes through primary cleaners 31 and fan pump 29 and thence to headbox 40 of the paper making machine. An additional supply of furnish, or more precisely water containing fines, is provided from silo 42.

As illustrated in FIG. 1, pH control means 34 is provided to control the pH of the furnish supplied to the headbox. The pH of the furnish in the headbox should be in the range of 6 to 8, more preferably, the range for the pH is 6 to 7, most preferably, the range for the pH is 6.5 to 7. A pH of approximately 6.75 is suitable to ensure that the tissue will have temporary wet strength, presumably via formation of hemiacetal bonds between the cationic aldehydic water soluble polymer and cellulose.

To help bring the softness of the sheet into the premium or near premium range, we have found that it is desirable to vary the jet/wire ratio to make the sheet a little squarer than we normally use in production of wet-pressed tissues. For example, as mentioned previously, in production of conventional wet press tissue, we normally control the jet to wire ratio so that the ratio of machine direction dry tensile strength to cross direction dry tensile strength of the basesheet (before converting and embossing) is about 2.5. For tissues of the present invention, we prefer to use a jet to wire ratio producing a base sheet having ratio of MD dry tensile to CD dry tensile of about 1.6 to 2.1, preferably from about 1.8 to 1.9.

Similarly, we prefer to impart more crepe to the web than we would normally use. For example, in conventional tissue, we would normally impart about 18–20% crepe to the web as it is creped off of the Yankee. For the tissues of the present invention, we prefer to impart a crepe of at least about 22%, more preferably at least about 23–24%.

Typically, the present inventors have found that dry strength is quite high in tissues incorporating sufficient amount of the temporary wet strength agent to be well suited for use premoistened. This high level of dry strength typically is accompanied by a very high tensile modulus which makes the sheet feel harsh to the user. This effect can be largely alleviated by addition of sufficient debonder/softener to increase the wet-to-dry ratio to levels above those usually resulting when these starches are used alone.

The amounts of cationic aldehydic water soluble monomer or polymer and softener added to the paper product are preferably regulated to obtain a ratio of cross direction wet tensile strength to cross direction dry tensile strength of over 18%, it being understood, of course, that when the tensile ratio is computed, the wet tensile strength (in g/in.) obtained in the Finch.Cup Test must be trebled to account for the difference in width between the three inch samples used for measuring dry tensile strength (reported in g/3 in.) and the samples that the Finch Cup is able to accommodate. A preferable range of the ratio is over at least about 20%, more preferably over about 22%,. and still more preferably approximately 23 to 24%. Most preferably, the ratio should be over 24%.

Preferred paper products of the present invention have a pleasing texture as indicated by the GM MMD of less than about 0.26 measured as described below and a tensile modulus of less than about 32 g/% strain, preferably less than 28 g/% strain, as determined by the procedure for measuring tensile strength as described herein except that the modulus recorded is the geometric mean of the slopes on the cross direction and machine direction load-strain curves from a load of 0 to 50 g/1" when a sample width of 1 inch is used.

Figure 7:
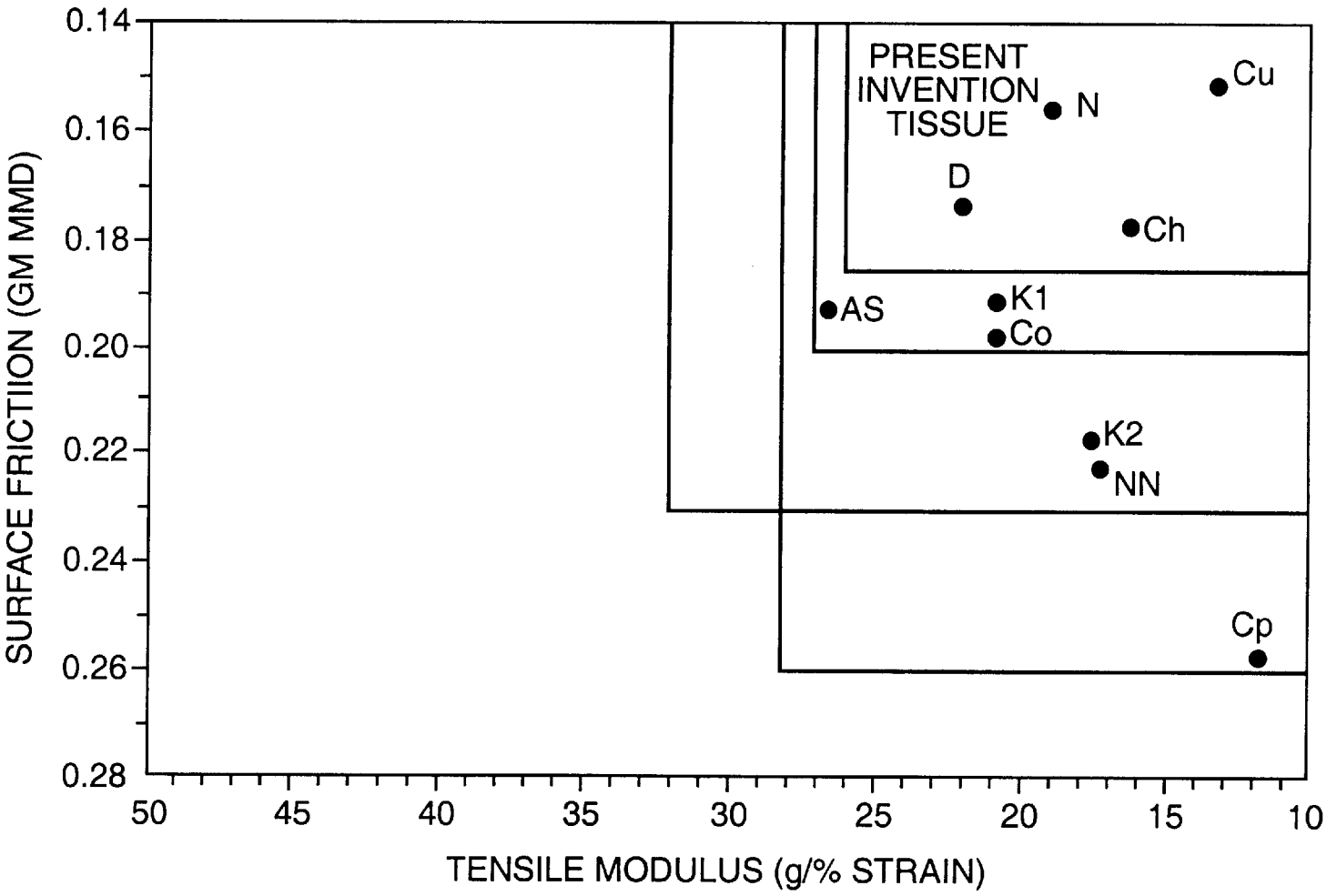
FIG. 7 is a graph showing the friction and tensile modulus of exemplary tissues of the present invention and comparing these to other premium or near premium tissues.

FIG. 7 is a graph showing the friction and tensile modulus of preferred tissues of the present invention in comparison to other premium or near premium tissues. All tensile moduli referred to herein should be understood to be measured at a tensile load of 50 g/in and reported in g/% strain, % strain being dimensionless.

Figure 2:
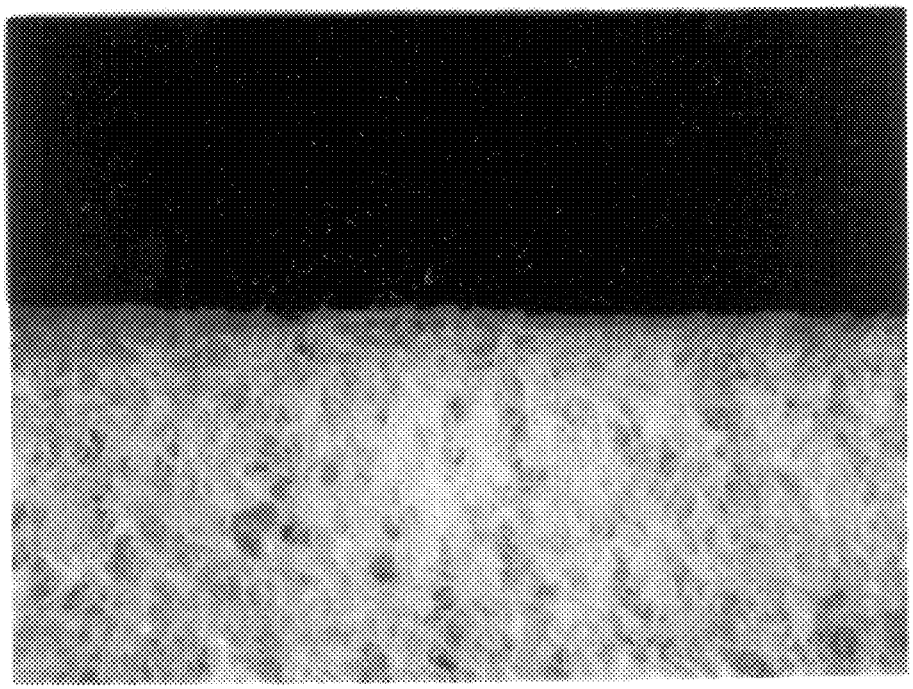
FIG. 2 is a photomicrograph taken at 20× of the surface of a tissue made according to the present invention as described in Example 10 illustrating the glabrous nature of the surface of tissues of the present invention.

FIG. 2 is a photomicrograph at an enlargement of about twenty times actual size illustrating the glabrous surface of a finished paper product according to the present invention. So far as the present inventors have been able to determine, the surface of the paper product of the present invention must be glabrous if the tissue is to achieve the five conflicting goals described above: (i) sufficient wet strength and resistance to wet abrasion to be well suited to be used premoistened; (ii) flushability; (iii) dispersibility and biodegradability; (iv) dry strength comparable to premium bath tissue; and (v) softness comparable to premium bath tissue.

The present inventors have found that, when coupled with sufficient temporary wet strength above the critical limit described herein, tissues having glabrous surfaces resist pilling of the fibers of the paper product when the paper product is moistened and rubbed so that the paper product may be moistened and used to cleanse the perineum and adjacent regions of the human body without pilling or shredding of the surface of the paper product and, in addition, an individual may use the paper product for cleansing these regions in a dry condition without discomfort.

Figure 3:
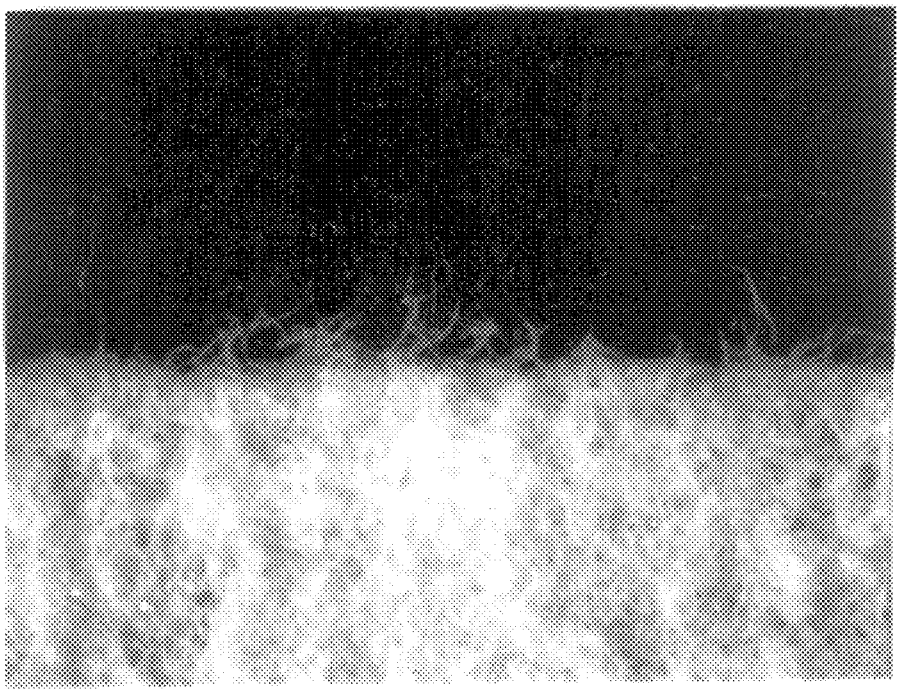
FIG. 3 is a photomicrograph of the surface of a competitive ("Brand Ch") tissue which possesses an initial CD wet tensile strength of ~28–32 g/in but possesses a crinose (non-glabrous) surface.

FIG. 3 is a photomicrograph at an enlargement of twenty times actual size of the surface of a paper product identified as Brand Ch illustrating the crinose or non-glabrous surface of the Brand Ch paper product having many fibers projecting therefrom. Pilling occurs readily when the Brand Ch paper product is premoistened and rubbed, so that while an individual may use the paper product for cleansing the perineum and adjacent regions of the human body in a dry or even slightly moist condition passingly well, if the Brand Ch paper product is premoistened and used to cleanse these regions, the surface of the tissue tends to pill or form small balls which may be difficult to remove, at least partially defeating the intent in using the product premoistened. Often the tissue will shred if used premoistened.

Tissues of the present invention exhibit substantial ability to resist wet abrasion thereby enabling them to be used premoistened for effective cleansing. To evaluate the ability of a tissue to resist wet abrasion and to quantify the degree of pilling when a moistened tissue is wetted and rubbed, we employ the following test using a Sutherland Rub tester to reproducibly rub tissue over a pigskin surface which is considered to be a fair substitute for human skin, the similarity being noted in U.S. Pat. No. 4,112,167. Four sheets of tissue are severed from a roll of tissue. The sheets are stacked so that the machine direction in each sheet is parallel to that of the others. By use of a paper cutter, the sheets are cut into specimens 2 inches in width and 4.5 inches in length.

A pigskin is stretched over the rubbing surface of a Sutherland Rub tester which is described in U.S. Pat. No. 2,734,375. The pigskin is preconditioned by spraying a mist of demineralized water at neutral pH from a mist spray bottle until the pigskin is saturated. However, care should be taken to ensure that no excess water, or puddling, remains on the surface of the pigskin. A sponge is positioned in a tray and the tray is filled with ¾ inch of demineralized neutral pH water. A smooth blotter stock is positioned on the top of the sponge.

A specimen is clamped between two clamps at each end of a transparent plexiglas rub block which is adapted to be removably secured to moving arm of the Sutherland Rub tester, the clamps being positioned to hold the sheet to be tested against the rubbing surface of the rub block by wrapping the specimen around the lower portion of the block with the MD direction of the sample parallel to the direction of movement of the rubbing arm. The rub block with the specimen is placed onto the smooth surface of the blotter stock. The specimen is carefully watched through the transparent rub block until the specimen is saturated with water, at which point, the rub block with the specimen is removed from the blotter stock. At this stage, the specimen will be sagging since it expands upon wetting. The sag is removed from the specimen by opening a clamp on the rub block permitting the operator to ease the excess material into the clamp, removing the sag and allowing the sample to be thereafter reclamped so that it conforms to the lower surface of the rub block, the length of wet material matching the distance between the two clamps.

The Sutherland Rub tester is set for the desired number of strokes. The pigskin is moistened by using three mist applications of water from the spray bottle. After the water is absorbed into the pigskin and no puddles are present, the transparent rub block bearing the specimen is affixed to the arm of the Sutherland Rub tester and the specimen brought into contact with the pigskin. Upon activation, the specimen is rubbed against the pigskin for the predetermined desired number of strokes. Normally, only a few seconds, ideally less than about 10 seconds will elapse between first wetting the tissue and activation of the Sutherland Rub Tester. Thereafter, the specimen is detached from the Sutherland Rub tester and evaluated to determine the condition of the specimen, particularly whether pilling, shredding or balling of tissue on the rub block has occurred. Thereafter, the pigskin surface and the rub block are cleaned to prepare for the next specimen.

For convenience, we define a quantity which we term the "Wet Abrasion Resistance Number" or WARN as being the number of strokes that the specimen will endure on this test before pilling is observed on the pigskin. For purposes of this invention, we prefer structures having a Wet Abrasion Resistance Number of at least about 4, more preferably at least about 8. For toweling, we prefer a WARN of at least about 8, more preferably at least about 15.

Figure 4A:
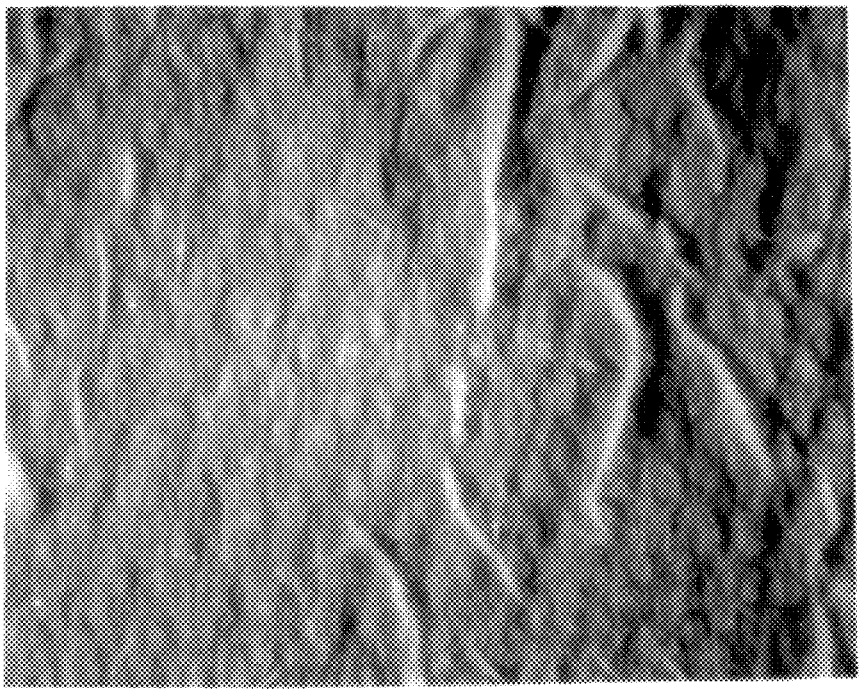
FIG. 4A is a photomicrograph of a moistened tissue sample of Brand Ch tissue illustrating the pilling occurring after three rubs over a pigskin surface.

FIG. 4A is a photomicrograph taken at a magnification of 6× of a moistened Brand Ch tissue which has been tested on the Sutherland Rub tester according to the test method described above subjecting the moistened tissue to only three strokes over the pigskin. As is apparent from FIG. 4A, the Brand Ch tissue exhibited substantial pilling and balling of the tissue after completion of the test method. Often, when subjected to this test, the tissue of brand Ch will tear or shred before four strokes are completed.

Figure 4B:
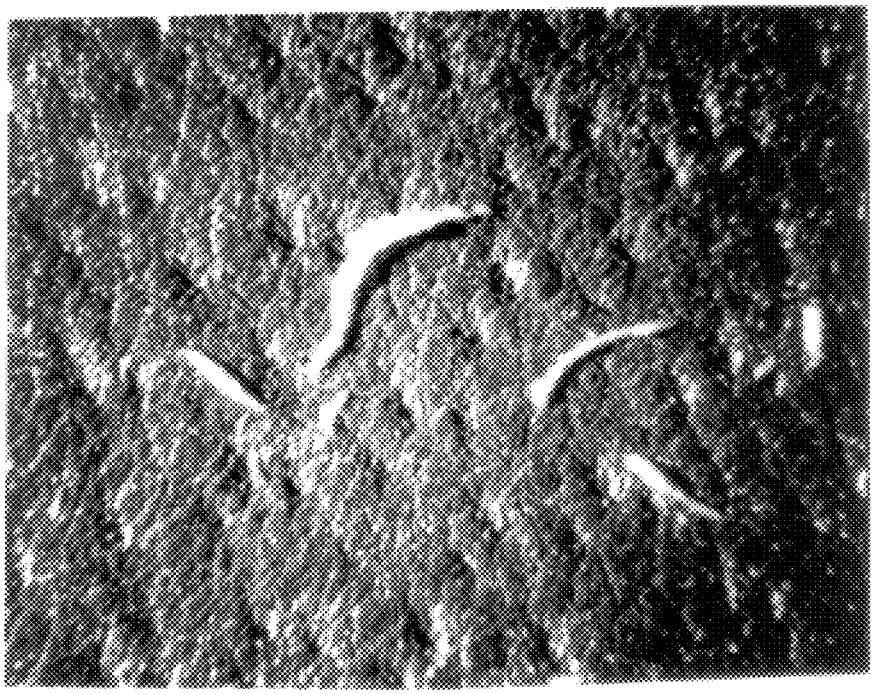
FIG. 4B is a photomicrograph of the pigskin illustrating the pills left behind after three rubs of a moistened Brand Ch tissue over the pigskin surface.

FIG. 4B is a photograph of the pigskin after the moistened Brand Ch tissue was tested on the Sutherland Rub tester for three rubs according to the test method described above. The photograph shows substantial detritus from excessive pilling and balling remaining after completion of the test.

Figure 5A:
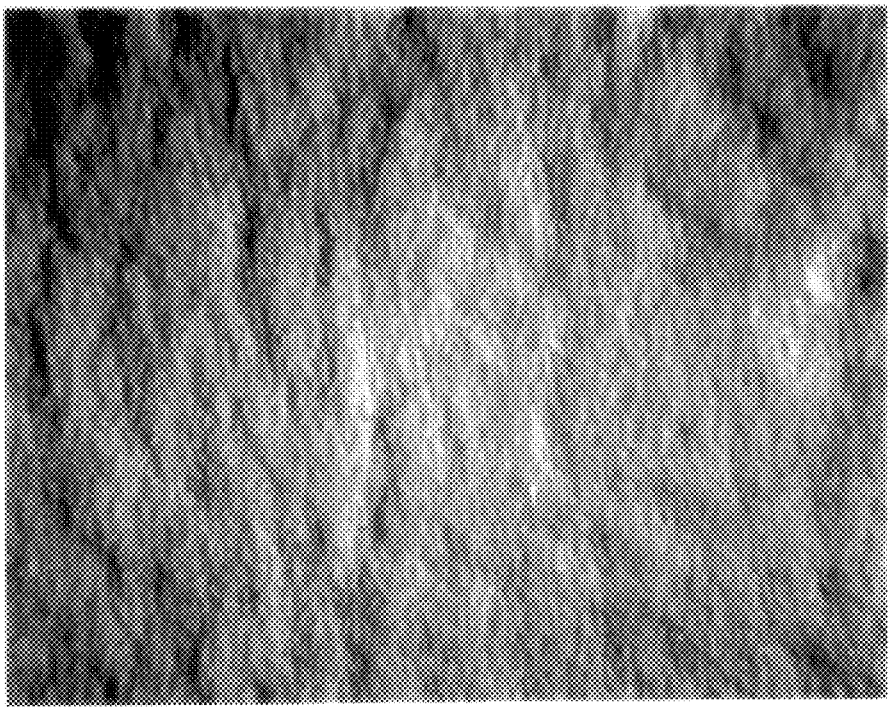
FIG. 5A is a photomicrograph of a tissue of the present invention illustrating its ability to withstand four rubs over a pigskin surface without pilling.

FIG. 5A is a photograph of a moistened tissue of the present invention which has been tested on the Sutherland Rub tester according to the test method described above subjecting the moistened tissue to four strokes over the pigskin. After completion of the test, the tissue according to the present invention did not exhibit pilling, shredding or balling of the tissue.

Figure 5B:
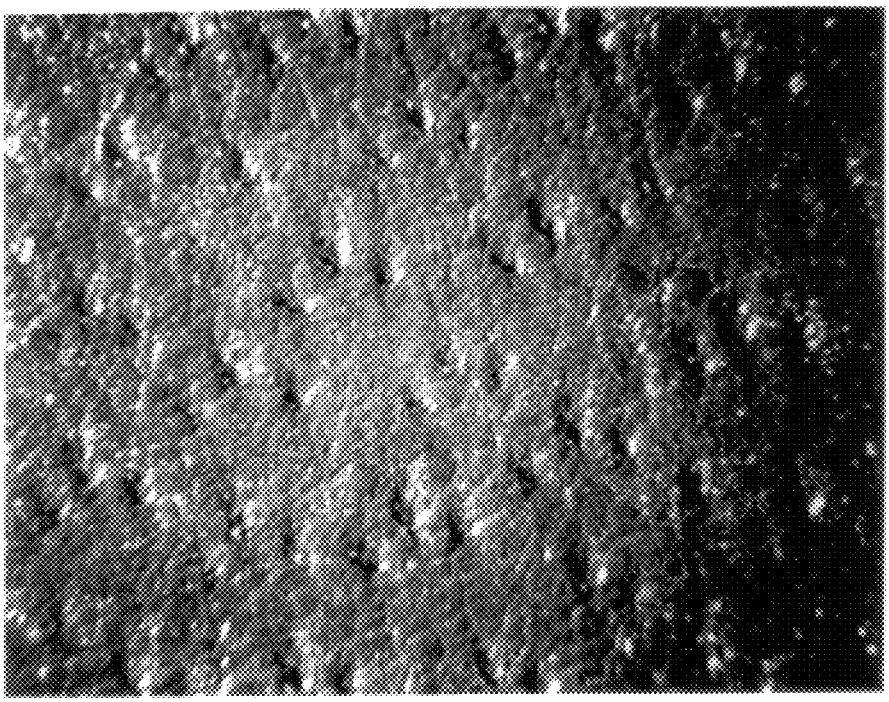
FIG. 5B is a photomicrograph of the pigskin after four rubs of a moistened tissue according to the present invention over the pigskin surface illustrating that the pigskin surface remains clean after 4 rubs with the tissue of the present invention.

FIG. 5B is a photograph of the pigskin after the moistened tissue according to the present invention was subjected to the test described above. As is apparent from FIG. 5B, even though the surface of the pigskin was littered with detritus severed from the tissue when Brand Ch tissue was tested, the pigskin remained clean after testing of the tissue of the present invention.

Figure 6:
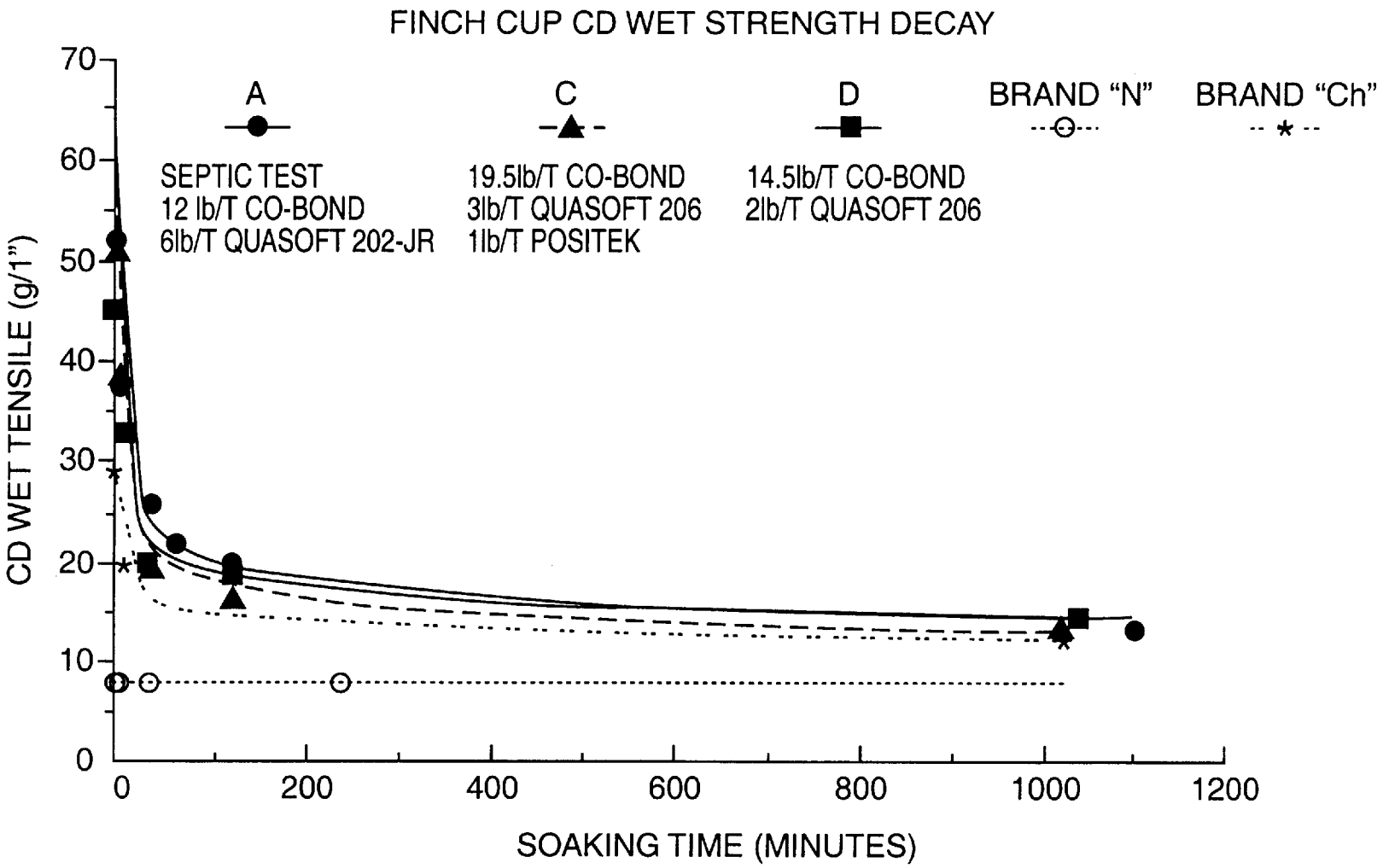
FIG. 6 is a graph of CD wet tensile strength measured over time for a variety of paper tissues including some made according to the present invention.

FIG. 6 is a graph illustrating the CD tensile strength measured over time for two tissues of the present invention, Samples A, C and D, as compared to brand Ch and brand N, while FIG. 7 compares the friction and tensile modulus of preferred tissues of the present invention in comparison to other premium or near premium tissues. Samples A, C and D are made as described in Examples 8, 9 and 10 respectively. There is no Sample B which was deleted as it possessed permanent wet strength which is believed to result from an interaction between an incompatible combination of starch and retention aid.

Sample A is made with a furnish of sixty percent southern hardwood kraft, forty percent northern softwood kraft as described below in more detail. Cationic aldehydic starch is added to the furnish in the amount of 12 pounds per ton. Six pounds per ton of nitrogenous cationic softener/debonder is applied to the web of sample C by spraying while the web is on the felt. Sample C demonstrates a relatively high initial CD wet tensile strength of approximately 53 g/1" as measured on a Finch Cup test. Over time, the CD wet tensile strength decreases to approximately 14 g/1".

Tissue corresponding to Sample A was tested in an independent testing laboratory which confirmed that the tissue was both sufficiently dispersible and biodegradable to be suitable for use in sewer and septic systems. (Throughout this specification and claims, the terms biodegradable and degradable should be considered synonymous.) This testing also confirmed that tissue corresponding to Sample A was at least as flushable as tissue of brand Ch.

Brand Ch is a premium tissue which is currently available in most grocery stores. The tissue apparently does contain a temporary wet strength agent similar to the cationic aldehydic starch preferred for use in the present invention as it possesses considerable wet strength which decays with time. However, patent numbers on the tissue package suggest that the tissue is made by means of a through air drying technique. In addition, the structure of the tissue seems to be consistent with through air drying particularly as the exterior surface, as illustrated in FIG. 3, is covered with a large number of fibers projecting therefrom. As discussed above, when attempts were made to use the Brand Ch tissue in a premoistened condition, the tissue pilled or shredded, producing small balls of fibers when rubbed. Thus, even though Brand Ch possesses a degree of initial CD wet tensile strength, this particular product should not normally be considered desirable for use in a premoistened condition.

Brand N is a premium tissue which is made by the assignee of the present invention and is currently available in most grocery stores. This particular tissue does not contain any wet strength resin so both the initial and long term CD wet tensile strengths are quite low.

The most preferred initial cross-machine direction wet tensile strength for a tissue of the present invention is approximately 45 g/1" when the tissue is drawn after five seconds of immersion in a Finch Cup testing fixture. Within about 30 minutes after immersion, the CD wet tensile decreases to about ⅔ of the initial value. Over time, the cross-machine direction wet tensile strength ultimately decreases to approximately 14–18 g/1".

The initial normalized geometric mean wet tensile strength should be approximately 68 g/1" for a tissue made according to the present invention when a tissue is immersed in a Finch Cup testing fixture and drawn after five seconds. Over time, the geometric mean tensile strength decreases to approximately 25 g/1". For flushable toweling, the initial normalized CD wet tensile should be at least about 50 g/in, or 150 g/3in. Preferably for toweling, the initial normalized CD wet tensile will exceed 100 g/in., more preferably over 125 g/in. After immersion in water for a period of thirty minutes, CD wet tensile for toweling should drop to less than about ⅔ of the initial value, more preferably the normalized CD wet tensile should ultimately drop to about 20–25 g/in. in about 10 hours. Normalized dry tensile for toweling will normally exceed about 350 g/in or, more preferably, 1100 g/3in.

Figure 8:
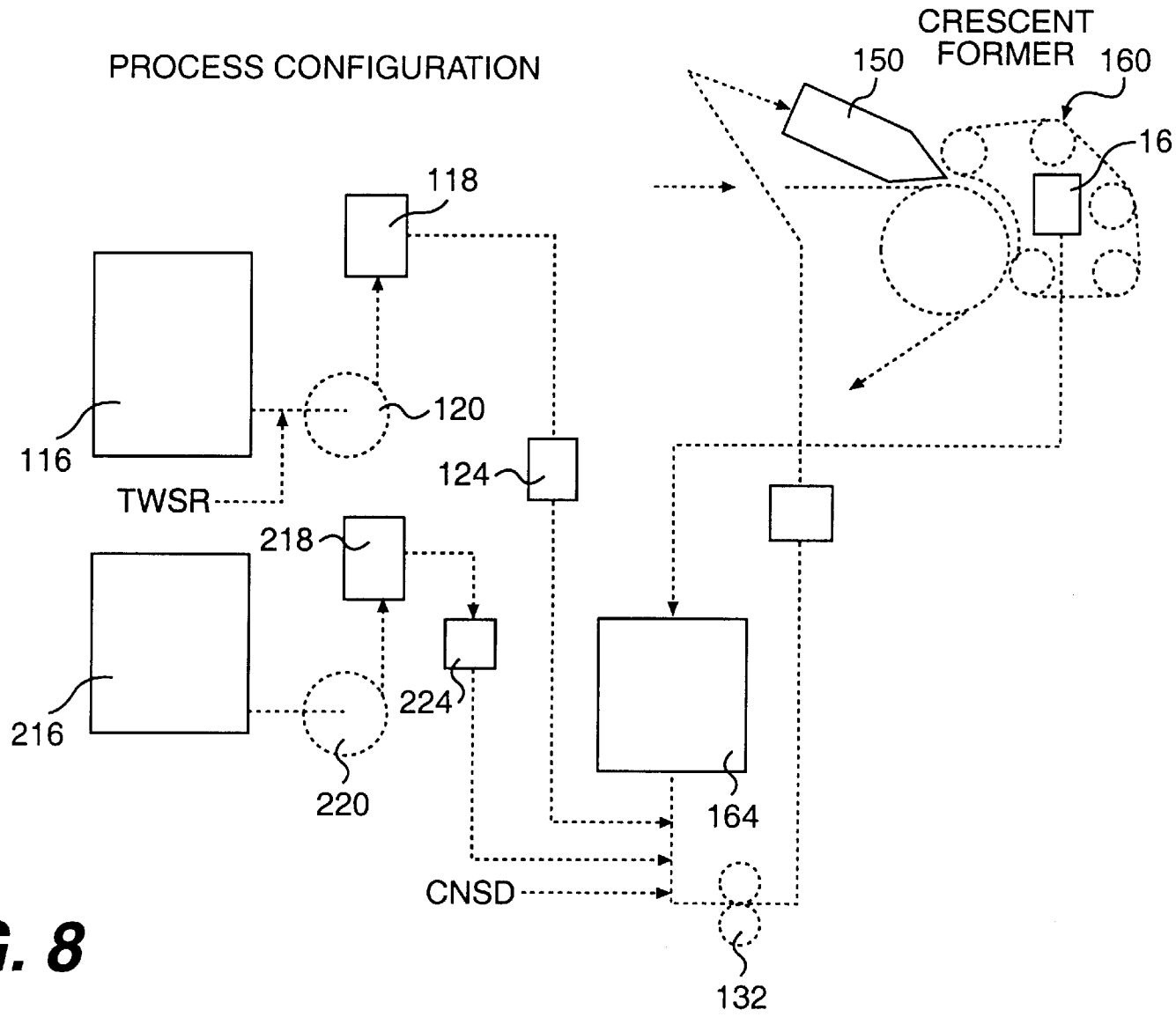
FIG. 8 is a schematic flow diagram of a furnish supply for a papermaking machine having two machine chests and the potential points of addition of temporary wet strength resin and a softener/debonder.

FIG. 8 illustrates another embodiment of the present invention wherein two machine chests are used for preparing the furnish. First machine chest 116 is provided for processing the softwood kraft with a pH of approximately 7. First machine chest pump 120 pumps the furnish from first machine chest 116 to first stuff box 118. Flow meter 124 is provided for detecting the basis weight of the furnish as the furnish is supplied to fan pump 132 for delivery to headbox 150. Headbox 150 supplies the furnish to crescent former paper making machine 160. Saveall 162 is provided for returning furnish supplied to the wire of crescent former paper making machine 160 back to fan pump silo 164 for subsequent supply to fan pump 132.

Second machine chest 216 is provided for processing the hardwood kraft with a pH of approximately 7. Second machine chest pump 220 pumps the furnish from second machine chest 216 to second stuff box 218. Flow meter 224 is provided for detecting the basis weight of the furnish as the furnish is supplied to fan pump 132 for delivery to headbox 150.

Cationic aldehydic starch is added to the softwood kraft furnish or the mixture of softwood and recycle furnish after the furnish is prepared in first machine chest 116. By allowing the longer cellulose fibers in the softwood kraft furnish to react with the starch, the temporary wet strength can be brought into the desired range. We prefer to contact the cationic aldehydic temporary wet strength resin primarily with the softwood fibers while the hardwood fibers may be contacted primarily with the cationic nitrogenous softener/debonder. Alternatively, the cationic aldehydic temporary wet strength resin may be added to the overall furnish first and the cationic nitrogenous softener/debonder added after the cationic aldehydic temporary wet strength resin has had time to react with the furnish.

In our process, the usual conventional papermaking fibers are suitable. We utilize softwood, hardwood, chemical pulp obtained from softwood and/or hardwood by treatment with sulfate or sulfite moieties, mechanical pulp obtained by mechanical treatment of softwood and/or hardwood, and recycle fiber.

Nitrogenous cationic softener/debonder is added to the hardwood kraft furnish after flow meter 224 for determining the basis weight of the furnish prepared by second machine chest 216. Hardwood kraft includes shorter fibers and more fines as compared to softwood kraft.

Headbox 150 for supplies furnish to crescent former paper making machine 160. Headbox 150 may be either homogeneous or stratified with separate supplies of furnish for making a stratified layered tissue on crescent former 160.

After drying, the tissue is creped off the Yankee. To bring perceived softness into the desired range, we prefer to impart more crepe to the web than we would normally use. For example, in conventional tissue, we would normally impart about 18–20% crepe to the web as it is creped off of the Yankee. For the present tissues, we prefer to impart a crepe of at least about 22%, more preferably at least about 23 to 24%.

Depending on the basis weight of the furnish and conventional processing steps applied to the web, the paper product may be used as a tissue, a towel, a facial tissue or a baby wipe.

EXAMPLE 1

A furnish of 65 percent southern softwood kraft and 35 percent southern hardwood kraft refined to a freeness of 610 CSF was prepared incorporating approximately 8 pounds of water soluble cationic polymer comprising aldehydic starch as a temporary wet strength resin per ton of furnish added to the machine chest, the pH in the head box being from about 6.5 to 7.5, more precisely between 6.5 and 7.0. The paper making machine is configured as a crescent former having a 12 ft. Yankee dryer operating at a speed of 3,225 feet per minute.

Calendering is utilized to control the caliper to approximately 29–35 mils per eight sheets, preferably 31–33 mils. Two basesheets are embossed together air-side to air-side to form a two ply tissue having a basis weight of about 18.9 lbs/3000 sq ft ream. After aging for seven days, the paper product formed, being denoted Tissue W-1, has an initial cross direction wet tensile FCT of about 32 g/1", a cross direction dry tensile of 509 g/3", a modulus of about 19.2 g/% strain and a friction (GM MMD) of 0.165. The ratio of machine direction dry tensile to cross-direction dry tensile is 2.2.

Figure 2A:
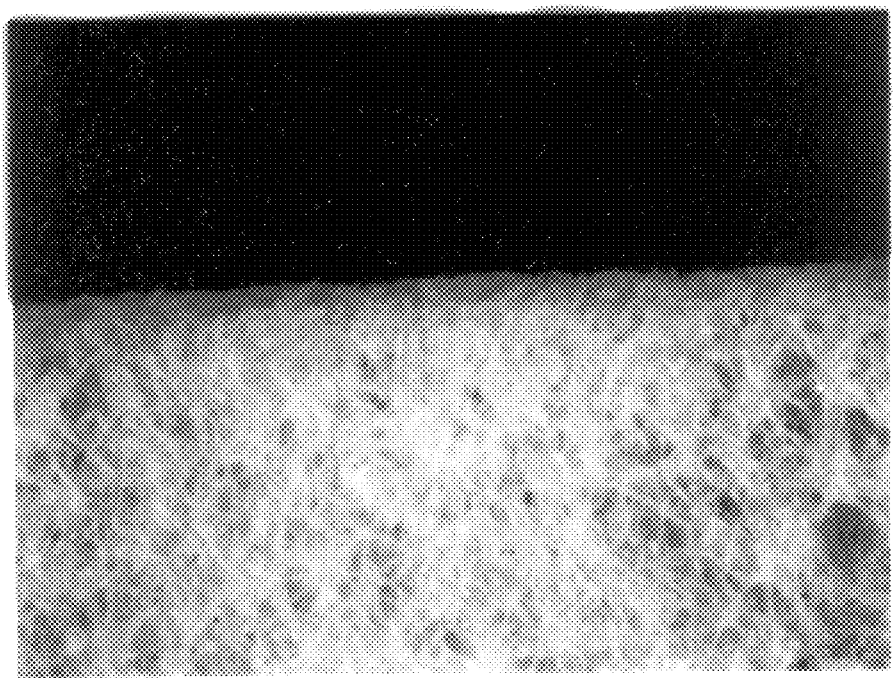

FIG. 2A is a photomicrograph taken at 20× of this tissue illustrating the glabrous nature of the surface thereof.

Figure 2B:
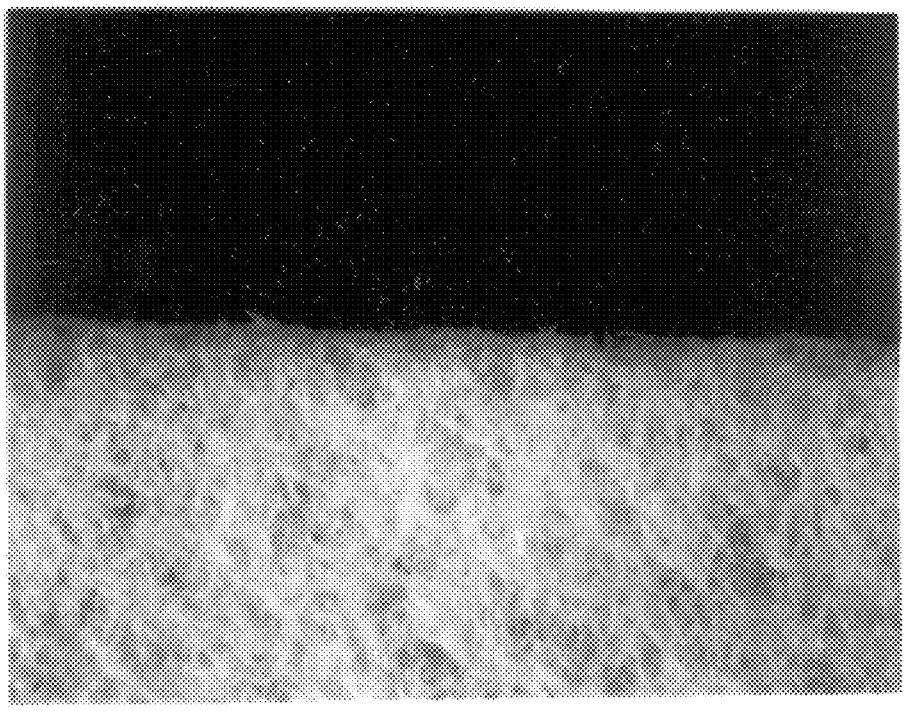

When this example is repeated using 65% SHWK and 35% SSWK refined to a CSF of 150 but with 6 lb/ton of Co-Bond and 1.5 lb/ton of cationic nitrogenous softener/debonder ("CNSD"), the CD wet tensile resulting was approximately 24 FCT; that sample, being denoted Tissue X-1, having a cross direction dry tensile of 420 g/3", a modulus of about 20.1 g/% strain and a friction (GM MMD) of 0.159. The ratio of machine direction dry tensile to cross-direction dry tensile is 2.3. FIG. 2B is a photomicrograph taken at 20× illustrating the marginally glabrous surface of Tissue X-1.

EXAMPLE 2

Through Air Dried ("TAD") tissues were constructed following as closely as practicable the working examples set forth in U.S. Pat. Nos. 5,217,576 and 5,240,562, ("van Phan 1 & 2", respectively). For purposes of comparison, the same general procedure was also used to prepare Conventional Wet Press ("CWP") tissues; one sample, denoted as X-2, being prepared using the proportions suggested by van Phan, while in another, Y-2, the proportions were modified to increase the temporary wet strength into the lower part of the range required for practice of this invention. It is not known if a product is commercially available which is made according to the disclosure of this patent.

More specifically, a furnish of thirty percent Northern SWK and seventy percent Eucalyptus was prepared. Cationic Aldehydic Starch (Co-Bond® 1000) with 1% solids @ 4.5 lbs/ton, CNSD (Varisoft® 137 from Sherex Chemicals of Dublin, Ohio) and PEG-400 from Aldrich Chemicals as a plasticizer at equimolar compositions resulting in a 1% solution were added to the furnish @ 2.8 lbs/ton. The chemically treated furnish was supplied as a homogenous slurry to an inclined forming wire then dewatered and dried in accordance with the usual commercial practice for the respective manufacturing technique, CWP or TAD, as the case may be.

The tissues were creped from the Yankee dryer at a bevel blade angle of 150 with a 4% reel moisture @ 20% crepe for the wet press tissue and 12.5% crepe for the through air dried. Calendering of the wet press tissue controlled the caliper to about 29–35 mils per 8 sheets, while calendering of the TAD tissues controlled the caliper and basis weight to about double that of the CWP tissue, the CWP tissue plies being embossed together to yield a two-ply product of equivalent weight.

Figure 3A:
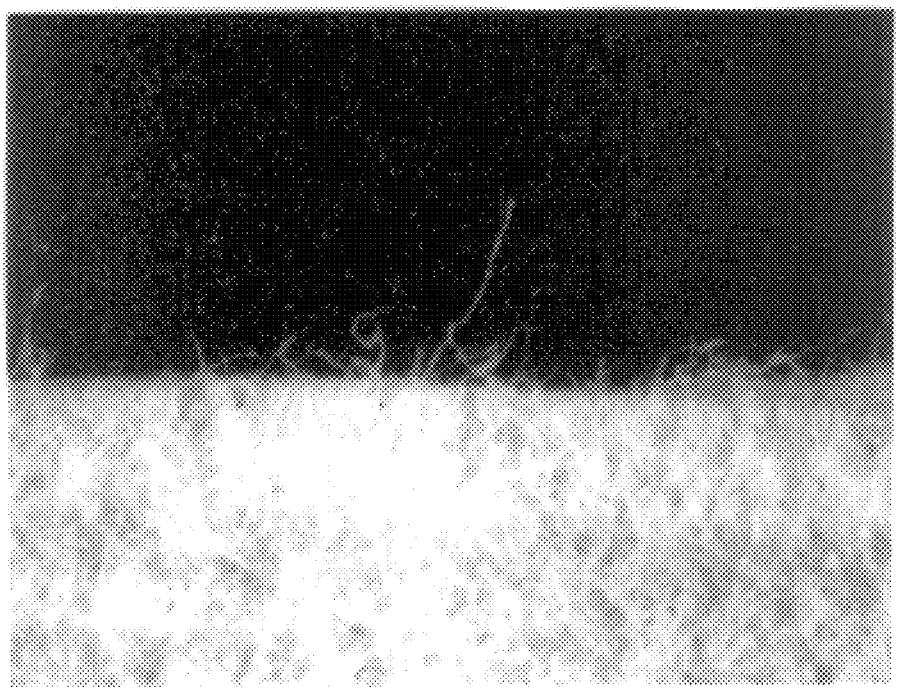
FIG. 3A is a photomicrograph taken at 20× of another tissue, denoted Tissue W-2, having an initial wet strength of about 49 g/in and possessing a crinose (non-glabrous) surface made following the teachings of van Phan, U.S. Pat. Nos. 5,217,576 and 5,240,562 as closely as practicable as described in Example 2 hereof.

The basis weight per ream of the through air dried sample, Tissue W-2, was 16.8 lbs/3000 sq ft ream. The surface of this tissue was distinctly non-glabrous having numerous fibers projecting considerably therefrom as can be seen in FIG. 3A. The cross-direction dry tensile strength was 894 g/3 in. Finch Cup tests conducted with samples of the through air dried tissue W-2 indicated an FCT averaging 49.1 g/in. with a standard deviation of 7.5 g/in. The basis weight of the wet press sample, Tissue X-2, was 17.1 lbs/3000 sq ft ream. The cross-direction dry tensile strength was 315 g/in. The surface of this tissue was marginally glabrous as can be seen from FIG. 3B in which small fibrils can be seen projecting from the surface. Wet tensile Finch Cup tests were conducted on samples of the wet press tissue X-2 indicating an FCT of 18.2 g/in. with a standard deviation of 0.85 g/in.

Figure 2C:
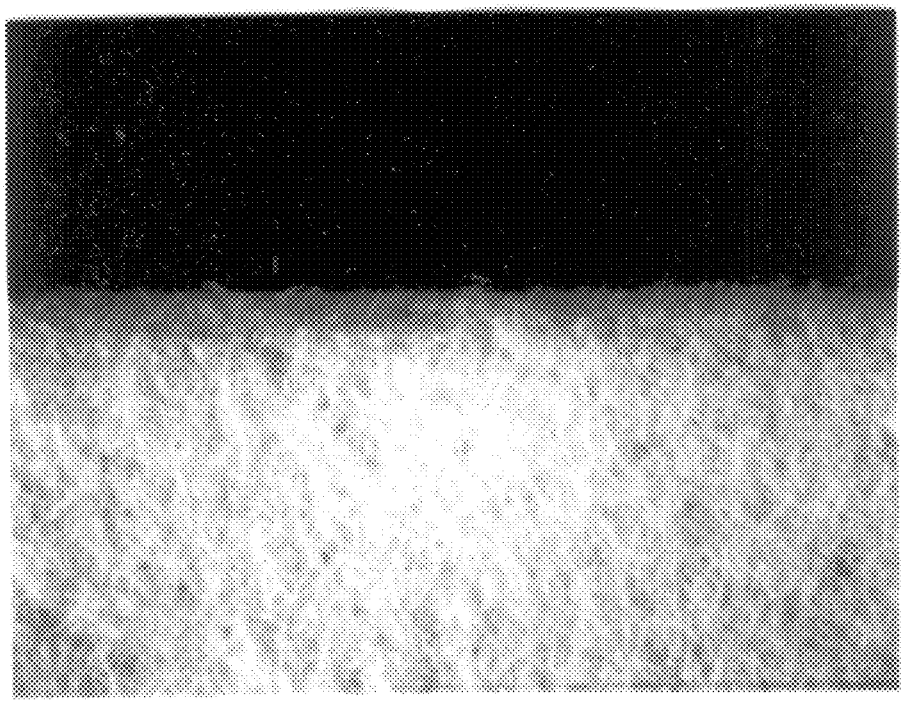

The CWP procedure above in this example was repeated to prepare CWP samples, denoted Tissue Y-2, having TWSR and CNSD in amounts of 15 lbs/ton and 2.8 lbs/ton, respectively. Finch Cup tests conducted with samples of the wet press tissue Y-2 indicated Finch Cup Test of 32.3 g/in. having a standard deviation of 2.12 g/in. As seen in FIG. 2C, the surface of Tissue Y-2 is distinctly more glabrous than the surface of Tissue X-2 which we term only marginally glabrous.

EXAMPLE 3

Samples prepared as above in Examples 1 and 2 were subjected to a wet abrasion test as described above.

When the CWP Tissue W-1 from Example 1 having a CD wet tensile of 32 FCT was tested, it survived 8 strokes with no pilling and no tearing. This sample exhibited a glabrous surface as shown in FIG. 2A. When Tissue X-1 having a CD wet tensile of 24 was tested for wet abrasion, it failed by pilling after 4 strokes.

It was observed that the TAD sample W-2 from Example 2 exhibited a non-glabrous or crinose surface as shown in FIG. 3A. When subjected to the wet abrasion test, small pills were observed after one stroke. Bigger pills were observed after two strokes. After three strokes, the abrasion from the fiber pilling caused the sheets to start rolling off the block.

Figure 3B:
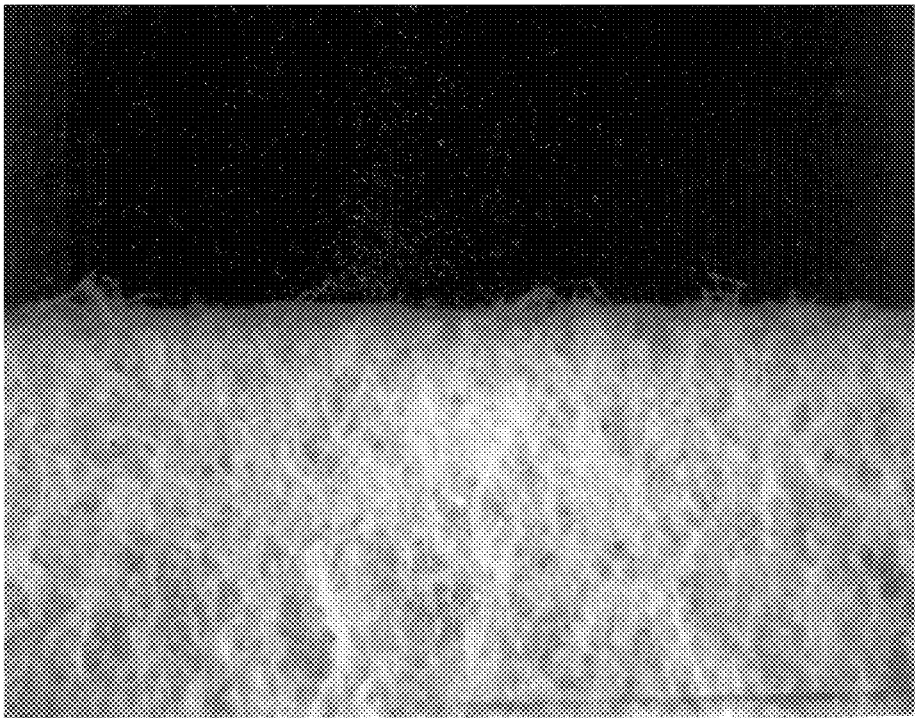
FIG. 3B is a photomicrograph taken at 20× of another tissue, denoted Tissue X-2, having an initial wet strength of about 18 g/in and possessing a crinose (non-glabrous) surface made following the teachings of van Phan U.S. Pat. Nos. 5,217,576 and 5,240,562 as modified for wet pressing as described in Example 2 hereof.

On the other hand, the CWP tissue X-2 of Example 2 exhibited a glabrous surface as shown in FIG. 3B. Tissue X-2 having a FCT of 18.2 failed by tearing on the first rub while Tissue Y-2 having an FCT of 32.3 survived 4 rubs and failed on the fifth rub. However, it was noted that sample Y-2 failed by tearing with minimal pilling. The low degree of pilling is believed to be attributable to the combination of the glabrous surface and initial temporary CD wet tensile strength above 25 g/in.

Accordingly, it can be seen that CWP products made following the van Phan procedure as closely as practicable, given the limited detail presented therein, are poorly suited for use premoistened, while if the van Phan procedure is modified to produce tissues having both a glabrous surface and temporary wet strength in strength range above about 25 FCT, the resulting tissues are usable but, if the strength is in the lower part of this range and the surface is less than perfectly glabrous, the reduced strength and increased tendency to pilling makes them somewhat less desirable than glabrous tissues made with perfectly glabrous surfaces and higher levels of wet strength such as 35 FCT or higher as described below. The difference between Tissues W-1 and Y-2, both having wet strengths of about 32 g/in is believed to be attributable to the presence of small fibrils projecting from the surface of sample Y-2 as opposed to the almost perfectly glabrous surface of W-1.

EXAMPLE 4

The procedure of Example 3 was repeated with a commercially purchased tissue ("Brand Ch") manufactured by the assignee of the above-mentioned van Phan patents. This tissue and its brand-mates seem to be the only major bathroom tissues on the market having wet strength approaching the levels required for the practice of this invention. The CD wet tensile of this product typically averages around 28–32 g/in. FCT. When subjected to the wet abrasion test, significant pilling is observed on the pig skin after about 2 strokes but the sheets hold together, in a gross sense, until about 4 strokes when a very high level of pilling is observed with the pills being quite large and often leading to failure.

FIG. 4A is a photomicrograph taken at 6× illustrating the pills observed on the tissue after 3 strokes.

FIG. 4B is a photomicrograph taken at 6× illustrating the pills observed on the pigskin after 3 strokes.

Accordingly, it can be appreciated that if extra cleaning ability is desired, this tissue and the others having non-glabrous surfaces are not really well suited to be used in a premoistened condition as the detritus left behind by the pilling will seriously detract from the desired extra cleansing.

EXAMPLE 5

A variety of some of the more commercially significant bathroom tissue brands on the market were subjected to the Finch Cup Test. All of these tissues had basis weights in the range of around 17 to 20 lbs/3000 sq ft ream. As can be seen from the results set out in Table I, only Charmin—brand Ch—and its brandmates have a CD wet tensile approaching the level required for best practice of the present invention.

TABLE I

| | Finch Cup CD Wet Tensile Strength Grams/1" Width | |
|---|---|---|
| Bathroom Tissue/Code | Average | Standard Deviation |
| Tissue of Present Invention - D | 44.5 | 3.06 |
| Quilted Northern ® - N | 6.5 | 0.17 |
| Marina ® | 8.5 | 0.62 |
| Nice 'n Soft - NN | 12.2 | 0.72 |
| Charmin ® - Ch | 28.0 | 1.19 |
| Charmin ® Ultra - Cu | 8.8 | 0.31 |
| Charmin ® Plus - CP | 7.8 | 0.47 |
| Charmin ® Big Squeeze | 28.7 | 4.57 |
| Kleenex ® - K1 | 6.7 | 0.17 |
| Kleenex ® Double Roll - K2 | 5.5 | 0.31 |
| Cottonelle ® 0ne-Ply | 7.6 | 0.10 |
| Cottonelle ® Two-Ply - Co | 7.7 | 0.12 |
| Cottonelle ® Hypo-Allergenic | 7.7 | 0.12 |
| Waldorf ® | 9.0 | 0.60 |
| Coronet ® | 15.1 | 1.21 |
| Angel Soft ® - AS | 13.0 | 0.40 |
| MD ® | 11.3 | 0.17 |
| Soft 'N Gentle ® | 14.9 | 0.23 |
| Green Forest ® | 10.6 | 0.31 |

EXAMPLE 6

A furnish of sixty percent Southern hardwood kraft and forty percent Northern softwood kraft is prepared. Fifteen pounds of cationic aldehydic starch per ton of furnish is added to the machine chest prior to the headbox. Six pounds of CNSD per ton of furnish is added prior to the headbox. The pH in the machine chest is 6.5 to 7.5. The paper making machine is operated in a crescent forming mode with a 12 ft Yankee dryer at a speed of 2,000 feet per minute. Calendering is utilized to control the caliper of approximately 29–35 mils per eight sheets. A paper product is formed having an initial cross direction wet tensile of 50 g/1", a cross direction dry tensile of 585 g/3", a modulus of 21.3 g/% strain and a friction (GM MMD) of 0.149. After twenty-seven days, the cross direction wet tensile increased to 56 g/1", the cross direction dry tensile is 610 g/3", the modulus is 21.8 g/% strain and the friction is 0.145.

EXAMPLE 7

The procedure of example 6 was repeated except that the amount of Co-Bond® 1000 used was 12 lbs per ton rather than 15 lbs per ton. The tissue formed had an initial cross direction wet tensile of 40 g/1", a cross direction dry tensile of 523 g/3", a modulus of 19.4 g/% strain and a friction (GM MMD) of 0.149. After aging, the cross direction wet tensile increased to 50 g/1", the cross direction dry tensile is 535 g/3", the modulus is 19.1 g/% strain and the friction is 0.147.

EXAMPLE 8

The procedure of example 6 was repeated except that the furnish was 50% northern softwood kraft and 50% southern hardwood kraft and the cationic nitrogenous softener/debonder was applied by spraying it onto the sheet while the sheet was on the felt. The tissue formed had an aged cross direction wet tensile of about 52–55 g/1", a cross direction dry tensile of 660 g/3", a modulus of 23.0 g/% strain and a friction (GM MMD) of 0.152. As mentioned, independent testing confirmed that these tissues were sufficiently degradable and dispersible to be compatible with sewer and septic systems and that the tissues, despite their significant initial wet strength, were at least as flushable as brand Ch tissue. When subjected to the above-described wet abrasion resistance test for 4 strokes, these tissues survived the 4 strokes without pilling.

EXAMPLE 9

A furnish of 60 percent Southern hardwood kraft and 40 percent southern softwood kraft is prepared. Nineteen and five tenths pounds of Co-Bond® 1000 per ton of furnish is added prior to the headbox at the suction for the machine chest pump. Three pounds of Quasoft® 206-JR per ton of furnish is added prior to the headbox at the suction for the pump for the primary cleaners. Positek 8671 retention aid (anionic colloidal silica) is added in the amount of 1 lb/ton to the furnish after the pressure screen discharge. The pH in the head box is from about 6.5 to about 7.5; preferably from about 6.5 to 7.0 and most preferably about 6.75. The paper making machine is a suction breast roll former coupled with a conventional wet press dewatering section with a 15 ft. Yankee dryer operating at a speed of 4250 feet per minute.

After calendering, the tissue exhibits a glabrous surface and a caliper of approximately 29–35 mils per eight sheets. A paper product is formed having an initial cross direction wet tensile strength before aging of 43 g/1" by the FCT. After aging, the tissue exhibited a cross direction dry tensile of 706 g/3", a modulus of 24.9 g/% strain and a GM MMD friction of 0.186. After seven days, the cross direction wet tensile is 53 g/1". The ratio of the machine direction dry tensile to the cross-direction [cross direction] dry tensile is 1.7. The wet to dry ratio is 22.5%. The wet strength decay for this product is shown on FIG. 6 as Sample "C".

EXAMPLE 10

A furnish of 60 percent southern hardwood kraft and 40 percent southern softwood kraft is prepared. Fourteen and a half pounds of Co-Bond® 1000 per ton of furnish is added prior to the headbox. Two pounds of Quasoft® 206-JR per ton of furnish is added prior to the headbox. The pH in the headbox is from about 6.5 to about 7.5; preferably from about 6.5 to 7.0 and most preferably about 6.75. The paper making machine is suction breastroll former coupled to a conventional wet press dewatering section and a 15 ft. Yankee dryer operating at a speed of 4,450 feet per minute.

After calendering the tissue exhibits a glabrous surface and a caliper of approximately 29–35 mils per eight sheets. The calendered product is converted by embossing the two sheets together with an emboss pattern having shallow rounded stitchlike debossments arrayed in a sinuous gracile lines defining a grid of quilt-like hexagonal cells, alternating cells containing deeper and more sharply defined signature elements centered in their respective cells. The converted paper product formed has an initial cross direction wet tensile of 39 g/1" by the Finch Cup Test, a cross direction dry tensile of 617 g/3", a modulus of 21.5 g/% strain and a GM MMD of 0.166. The initial wet over dry ratio of the tissue is 19.0%. After seven days, the cross direction wet tensile is 44 g/1", the modulus is 22 g/% strain and the GM MMD friction is 0.173. The ratio of the machine direction dry tensile to cross-direction dry tensile is 1.95. The wet strength decay of this tissue is illustrated in FIG. 6 as Tissue "D".

Tissue D was subjected to the above described Wet Abrasion Resistance Test for 4 strokes. FIG. 5A is a photomicrograph taken at 6× illustrating the substantial absence of pilling on the surface of the tissue after this test. FIG. 5B is a photomicrograph taken at 6× illustrating the substantial absence of pilling on the surface of the pigskin after this test.

EXAMPLE 11

A furnish of thirty percent northern softwood kraft, thirty-five percent of secondary fibers, ten percent northern hardwood kraft and twenty-five percent repulped fibers from broke is prepared. Eighteen pounds of Co-Bond® 1000 per ton of furnish and six pounds of Quasoft® 202-JR per ton of furnish is added together at the primary cleaners. The pH in the head box loop is 6.7. The paper making machine is a suction breast roll former coupled with a conventional wet pressing felt section with a 12 ft Yankee dryer operating at a speed of 3,800 feet per minute. After calendering, the tissue exhibits a glabrous surface and a caliper of approximately 29–35 mils per eight sheets. A paper product is formed having relatively lower initial cross direction wet tensile of 37 g (as compared to the levels expected from the amount of starch used) because of the previously mentioned interaction occurring between the wet strength agent and the softener/debonder when they are not added separately.

EXAMPLE 12

A furnish of thirty percent northern softwood kraft, thirty-five percent of secondary fibers, ten percent northern hardwood kraft and twenty-five percent repulped fibers from broke is prepared. Eighteen pounds of Co-Bond® 1000 per ton of furnish is added to the stuff box. Six pounds of Quasoft® 202-JR per ton of furnish is added at the cleaners. The pH in the machine chest is 6.7. The paper making machine is a suction breast roll former coupled with a conventional wet press section employing dewatering felts and a 12 ft Yankee dryer operating at a speed of 3,850 feet per minute. After calendering, the tissue exhibits a glabrous surface and a caliper of approximately 29–35 mils per eight sheets. After conversion by embossing the two plies together, a tissue product is formed having an initial cross direction wet tensile of 44 g/1", a cross direction wet tensile strength of 551 g/3 in., a ratio of cross direction wet tensile to CD dry tensile of 0.24, a modulus of 26.8 g/% strain and a GM MMD friction of 0.197. The tensile ratio (MDT/CDT) was 2.4. The friction of the paper product is believed to be high due to pressing and embossing of the paper product. This example illustrates the benefits of adding the temporary wet strength agent to the furnish and allowing it to react before introducing the softener/debonder.

EXAMPLE 13

A furnish of thirty percent northern softwood kraft, thirty-five percent of secondary fibers, ten percent northern hardwood kraft and twenty-five percent repulped fiber from broke is prepared. Eighteen pounds of Co-Bond® 1000 per ton of furnish is added to the stuff box. Six pounds of Quasoft® 202-JR per ton of furnish is added at the cleaners. The pH in the machine chest is 6.7. The paper making machine is a suction breast roll former coupled to a conventional wet press felt dewatering section and a 12 ft Yankee dryer operating at a speed of 3,800 feet per minute.

In this example, as compared to the previous example, the jet speed was increased slightly, maintaining the same wire speed to bring the tensile ratio down slightly.

After calendering, the tissue exhibits a glabrous surface and a caliper of approximately 29–35 mils per eight sheets. After conversion by embossing the two plies together, a paper product is formed having an initial cross direction wet tensile of 47 g/1", a ratio of CD wet tensile strength to CD dry tensile strength of 0.252, a modulus of 28.2 and a friction of 0.202. The friction of the converted paper product is higher as compared to the basesheets due to pressing and embossing of the paper product. The tensile ratio obtained (MD/CD) was 2.26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dispersible tissue product having a glabrous surface and being adapted both for use in a dry condition and for use in a premoistened condition, said tissue having temporary wet strength and comprising a water soluble temporary wet strength agent comprising aldehydic units and cationic units, the amount of said water soluble temporary wet strength agent comprising aldehydic units being sufficient to produce an initial normalized CD wet tensile strength of at least about 25 g/1" strip 5 seconds after wetting as measured by the Finch Cup method; said tissue exhibiting a subsequent CD wet tensile, as measured 30 minutes after immersion, of less than about ⅔ of the initial CD wet tensile strength, said paper product in a moistened condition exhibiting a Wet Abrasion Resistance Number of at least about 4.

2. The tissue of claim 1 wherein the initial normalized CD wet tensile strength of said tissue is in excess of at least about 35 g/1" strip 5 seconds after immersion.

3. The tissue of claim 2 wherein the tensile modulus of the tissue is controlled within the range of less than 32 g/% strain, and the GM MMD of the tissue is controlled to less than 0.23.

4. The tissue of claim 2 wherein the wet abrasion resistance number of the tissue exceeds 8.

5. The tissue of claim 1 wherein the wet abrasion resistance number of the tissue exceeds 8, and wherein the normalized cross direction wet tensile strength as measured 10 hours subsequent to immersion is about 15 g/1" strip.

6. The tissue of claim 5 wherein the tensile modulus of the tissue is controlled within the range of less than 28 g/% strain, and the GM MMD of the tissue is controlled to less than 0.26.

7. The tissue of claim 1 further comprising a cationic nitrogenous softener/debonder, wherein the amounts of said cationic nitrogenous softener/debonder and said water soluble wet strength agent comprising aldehydic units are controlled to produce a ratio of cross direction wet tensile strength to cross direction dry tensile strength of over at least about 20%, and wherein the ultimate cross direction wet tensile strength as measured 10 hours subsequent to immersion is about 15 g/1" strip.

8. The tissue of claim 7 wherein processing and calendering of said tissue is controlled to produce a GM MMD friction of from about 0.100 to 0.185 and a modulus of from about 23.5 to 10 g/% strain.

9. The tissue of claim 1, further comprising a cationic nitrogenous softener/debonder, wherein the amounts of said cationic nitrogenous softener/debonder and said water soluble temporary wet strength agent comprising aldehydic units are controlled to produce a ratio of cross direction wet tensile strength to cross direction dry tensile strength of over at least about 22%.

10. The tissue of claim 1 wherein processing and calendering of said tissue is controlled to produce a GM MMD friction of from about 0.120 to 0.175 and a modulus of from about 22.5 to 10 g/% strain.

11. The tissue of claim 1 wherein the tensile modulus of the tissue is controlled within the range of less than 32 g/% strain, and the GM MMD of the tissue is controlled to less than 0.23.

12. The tissue of claim 11 wherein the initial normalized CD wet tensile strength of said tissue is in excess of at least about 35 g/1" strip as measured 5 seconds after immersion.

13. The tissue of claim 11, further comprising cationic nitrogenous softener/debonder, wherein the amounts of cationic nitrogenous softener/debonder and water soluble temporary wet strength agent comprising aldehydic units are controlled to produce a wet-to-dry GM tensile strength ratio of at least about 20%.

14. The tissue of claim 11, further comprising cationic nitrogenous softener/debonder, wherein the amounts of cationic nitrogenous softener/debonder and water soluble temporary wet strength agent comprising aldehydic units are controlled such that the tensile modulus of the tissue is controlled within the range of less than 26 g/% strain, and the GM MMD of the tissue is controlled to less than 0.185.

15. The tissue of claim 1, further comprising cationic nitrogenous softener/debonder, wherein the amounts of said cationic nitrogenous softener/debonder and said water soluble temporary wet strength agent comprising aldehydic units are controlled to produce a ratio of cross direction wet tensile strength to cross direction dry tensile strength of over at least about 24%.

16. The tissue of claim 1, wherein the ratio of machine direction dry tensile strength to cross direction dry tensile strength is no more than about 2.5.

17. The tissue of claim 1 wherein the ratio of machine direction dry tensile strength to cross direction dry tensile strength is no more than about 1.9.

18. The tissue of claim 1 wherein the ratio of machine direction dry tensile strength to cross direction dry tensile strength is no more than about 2.2.

19. The tissue of claim 1 wherein the ratio of machine direction dry tensile strength to cross direction dry tensile strength is between about 1.8 and about 2.5.

20. A biodegradable tissue product comprising a cellulosic web dewatered by substantially uniform compaction applied to the web by contact with a dewatering felt and passage through a nip including a suction pressure roll and being adapted both for use in a dry condition as well as premoistened shortly before use, said tissue having temporary wet strength, said tissue comprising a water soluble cationic temporary wet strength agent, the amount of said water soluble cationic temporary wet strength agent being sufficient to produce an initial normalized CD wet tensile strength of at least about 25 g/1" strip 5 seconds after immersion as measured by the Finch Cup method and a subsequent CD wet tensile of less than about ⅔ of the initial CD wet tensile as measured 30 minutes after immersion, said paper product in a moistened condition exhibiting a Wet Abrasion Resistance Number of at least about 4.

21. The tissue of claim 20 wherein the initial normalized CD wet tensile strength of said tissue is in excess of at least about 35 g/1" strip 5 seconds after immersion.

22. The tissue of claim 20 wherein the tensile modulus of the tissue is controlled within the range of less than 32 g/% strain, and the GM MMD of the tissue is controlled to less than 0.23.

23. The tissue of claim 22 wherein the tensile modulus of the tissue is controlled within the range of less than 28 g/% strain, and the GM MMD of the tissue is controlled to less than 0.26.

24. The tissue of claim 23, wherein the water soluble cationic temporary wet strength agent comprises aldehydic units, and further comprising cationic nitrogenous softener/debonder, wherein the amounts of cationic nitrogenous softener/debonder and water soluble temporary wet strength agent comprising aldehydic units are controlled to produce a wet-to-dry GM tensile strength ratio of at least about 20%.

25. The tissue of claim 23, further comprising cationic nitrogenous softener/debonder, wherein the amounts of cationic nitrogenous softener/debonder and water soluble temporary wet strength agent are controlled such that the tensile modulus of the tissue is controlled within the range of less than 26 g/% strain, and the GM MMD of the tissue is controlled to less than 0.185.

26. The tissue of claim 20, further comprising cationic nitrogenous softener/debonder, wherein the amounts of said cationic nitrogenous softener/debonder and said water soluble temporary wet strength agent are controlled to produce a ratio of cross direction wet tensile strength to cross direction dry tensile strength of over 18%, and wherein said tissue exhibits an initial normalized CD wet tensile strength of at least about 35 g/1" strip 5 seconds after immersion as measured by the Finch Cup method and a subsequent CD wet tensile of less than about ⅔ of the initial value as measured 30 minutes after immersion.

27. The tissue of claim 26 wherein the amounts of said cationic nitrogenous softener/debonder and said water soluble temporary wet strength agent are controlled to produce a ratio of cross direction wet tensile strength to cross direction dry tensile strength of over at least about 20%.

28. The tissue of claim 27 wherein the amounts of said cationic nitrogenous softener/debonder and said water soluble temporary wet strength agent are controlled to produce a ratio of cross direction wet tensile strength to cross direction dry tensile strength of over at least about 22%.

29. The tissue of claim 20 wherein the amounts of said cationic nitrogenous softener/debonder and said water soluble temporary wet strength agent are controlled to produce a ratio of cross direction wet tensile strength to cross direction dry tensile strength of over at least about 23 to 24%.

30. The tissue of claim 29 wherein the amounts of said cationic nitrogenous softener/debonder and said water soluble temporary wet strength agent are controlled to produce a ratio of cross direction wet tensile strength to cross direction dry tensile strength of over at least about 18%.

31. The tissue of claim 30 wherein processing and calendering of said tissue are controlled to produce a GM MMD friction of from about 0.100 to 0.185 and a modulus of from about 10 to 23.5 g/% strain.

32. The tissue of claim 30 wherein the amounts of said cationic nitrogenous softener/debonder and said water soluble temporary wet strength agent are controlled to produce a ratio of cross direction wet tensile strength to cross direction dry tensile strength of over 24%.

33. The tissue of claim 20 wherein the jet to wire ratio employed in the manufacture of said product is controlled to produce a ratio of machine direction dry tensile strength to cross direction dry tensile strength of less than about 2.5, and wherein said tissue exhibits an initial normalized CD wet tensile strength of at least about 35 g/1" strip 5 seconds after immersion as measured by the Finch Cup method and a ultimate normalized CD wet tensile of about 15 g/1" strip as measured 10 hours after immersion.

34. The tissue of claim 20 wherein the jet to wire ratio employed in the manufacture of said product is controlled to produce a ratio of machine direction dry tensile strength to cross direction dry tensile strength of less than about 2.5.

35. The tissue of claim 20 wherein the jet to wire ratio employed in the manufacture of said product is controlled to produce a ratio of machine direction dry tensile strength to cross direction dry tensile strength of less than about 2.2.

36. The tissue of claim 20 wherein the jet to wire ratio employed in the manufacture of said product is controlled to produce a ratio of machine direction dry tensile strength to cross direction dry tensile strength of from about 1.8 to about 2.5.

37. A temporary wet strength tissue paper product having a glabrous surface, said temporary wet strength tissue paper product comprising from approximately 20% to approximately 80% hardwood fiber by weight, from approximately 80% to 20% softwood fiber by weight, from about 2 pounds per ton to about 30 pounds per ton of a water-soluble temporary wet strength resin having aldehydic moieties on a cationic polymeric base and from about 1 pound per ton to about 10 pounds per ton of a cationic nitrogenous softener/debonder chosen from the group consisting of imidazolines, amido amine salts, linear amido amines, tetravalent ammonium salts and mixtures thereof, wherein the amounts of temporary wet strength resin and nitrogenous cationic softener/debonder are selected to yield an initial normalized CD wet tensile strength of greater than 25 g/1" with a normalized dry tensile strength of from at least about 133 g/1" strip of paper product up to about 267 g/1" strip, and a dry tensile modulus of from about 15.5 to about 45.5 g/% strain and 30 minutes after immersion exhibits an intermediate normalized CD wet tensile strength of less than ⅔ the initial value, said paper product in a moistened condition possessing substantial resistance to pilling and shredding when rubbed against pigskin.

38. The tissue of claim 37 wherein the initial normalized CD wet tensile strength of said tissue is in excess of at least about 35 g/1" strip 5 seconds after immersion, and the ratio of machine direction dry tensile to cross direction dry tensile is no more than about 2.2.

39. The tissue of claim 38 wherein the initial normalized CD wet tensile strength of said tissue is in excess of at least about 35 g/1" strip 5 seconds after immersion.

40. The tissue of claim 38 wherein the tensile modulus of the tissue is controlled within the range of less than 32 g/% strain, and the GM MMD of the tissue is controlled to less than 0.23.

41. The tissue of claim 40 wherein the wet abrasion resistance number of the tissue exceeds 8, and wherein said tissue exhibits an initial normalized CD wet tensile strength of at least about 35 g/1" strip 5 seconds after immersion as measured by the Finch Cup method and, 10 hours after immersion, an ultimate normalized CD wet tensile of less than about 15 g/in.

42. The tissue of claim 37 wherein the wet abrasion resistance number of the tissue exceeds 8.

43. The tissue of claim 42 wherein the tensile modulus of the tissue is controlled within the range of less than 28 g/% strain, and the GM MMD of the tissue is controlled to less than 0.26.

44. The tissue of claim 42, wherein the amounts of said cationic nitrogenous softener/debonder and said water soluble temporary wet strength resin having aldehydic moieties on a cationic polymeric base are controlled to produce a ratio of cross direction wet tensile strength to cross direction dry tensile strength of over at least about 20%, and wherein said tissue exhibits an initial normalized CD wet tensile strength of at least about 35 g/1" strip 5 seconds after immersion as measured by the Finch Cup method and, as measured 30 minutes after immersion, a subsequent normalized CD wet tensile of less than about ⅔ the initial value.

45. The tissue of claim 44 wherein processing and calendering of said tissue is controlled to produce a GM MMD friction of from about 0.100 to 0.185 and a modulus of from about 23.5 to 10 g/% strain.

46. The tissue of claim 37, wherein the amounts of said cationic nitrogenous softener/debonder and said water soluble temporary wet strength resin having aldehydic moieties on a cationic polymeric base are controlled to produce a ratio of cross direction wet tensile strength to cross direction dry tensile strength of over at least about 22%, and wherein said tissue exhibits an initial normalized CD wet tensile strength of at least about 35 g/1" strip 5 seconds after immersion as measured by the Finch Cup method and, as measured 30 minutes after immersion, a subsequent CD wet tensile of less than about ⅔ the initial value.

47. The tissue of claim 37 wherein processing and calendering of said tissue is controlled to produce a GM MMD friction of from about 0.100 to 0.175 and a modulus of from about 22.5 to 10 g/% strain.

48. The tissue of claim 47 wherein the tensile modulus of the tissue is controlled within the range of less than 32 g/% strain, and the GM MMD of the tissue is controlled to less than 0.23.

49. The tissue of claim 48 wherein the initial normalized CD wet tensile strength of said tissue is in excess of at least about 35 g/1" strip 5 seconds after immersion.

50. The tissue of claim 49, wherein the amounts of cationic nitrogenous softener/debonder and water soluble temporary wet strength resin having aldehydic moieties on a cationic polymeric base are controlled to produce a wet-to-dry GM tensile strength ratio of at least about 20%.

51. The tissue of claim 50, wherein the amounts of cationic nitrogenous softener/debonder and water soluble temporary wet strength resin having aldehydic moieties on a cationic polymeric base are controlled such that the tensile modulus of the tissue is controlled within the range of less than 26 g/% strain, and the GM MMD of the tissue is controlled to less than 0.185.

52. The tissue of claim 37, wherein the amounts of said cationic nitrogenous softener/debonder and said water soluble temporary wet strength resin having aldehydic moieties on a cationic polymeric base are controlled to produce a ratio of cross direction wet tensile strength to cross direction dry tensile strength of over at least about 24%.

53. A temporary wet strength tissue paper product comprising a cellulosic web having a glabrous surface, said web comprising from about 20% to about 80% hardwood fiber by weight, from about 80% to about 20% softwood fiber by weight; from about 5 pounds per ton to about 25 pounds per ton of a temporary wet strength resin having aldehydic moieties on a cationic waxy base comprising amylopectin and amylose in a ratio yielding temporary wet strength properties and from about 1 pound per ton to about 9 pounds per ton of a cationic nitrogenous softener/debonder chosen from the group consisting of imidazolines, amido amine salts, linear amine amides, tetravalent ammonium salts and mixtures thereof; wherein the amounts of temporary wet strength resin and nitrogenous cationic softener/debonder are selected to yield an initial normalized CD wet tensile strength of greater than 25 g/1" as measured by the Finch Cup Test and a normalized CD dry tensile strength of from at least about 133 g/1" strip of tissue paper product up to no more than about 267 g/1" strip, and a GM MMD friction of no more than 0.195 and, as measured 30 minutes after immersion in water, a subsequent CD wet tensile strength of less than ⅔ the initial value, said tissue paper product exhibiting a Wet Abrasion Resistance Number of at least about 4.

54. A temporary wet strength tissue paper product having a glabrous surface comprising from about 20% to about 80% hardwood fiber by weight, from about 80% to about 20% softwood fiber by weight; from about 8 pounds per ton to about 20 pounds per ton of a temporary wet strength resin having aldehydic moieties on a cationic waxy base comprising amylopectin and amylose in a ratio producing temporary wet strength properties and from about 1 pound per ton to about 9 pounds per ton of a cationic nitrogenous softener/debonder chosen from the group consisting of imidazolines, amido amine salts, linear amine amides, tetravalent ammonium salts and mixtures thereof; wherein the amounts of temporary wet strength resin and nitrogenous cationic softener/debonder are selected to yield an initial normalized CD wet tensile strength of greater than 35 g/1" and a normalized CD dry tensile strength of from at least about 133 g/1" strip of tissue paper product up to no more than about 267 g/1" strip, the ratio of machine direction dry tensile strength to cross direction dry tensile strength is from at least about 1.8 up to about 2.5; and wherein the ratio of initial wet geometric mean tensile strength to dry geometric mean tensile strength is at least about 0.18 and wherein, as measured 10 hours after immersion in water, a normalized CD wet tensile strength of about 15 g/1", said tissue paper product in a moistened condition being substantially free of pilling when rubbed.

55. A temporary wet strength tissue paper product having a glabrous surface comprising from about 20% to about 80% hardwood fiber by weight, from about 80% to about 20% softwood fiber by weight; from about 5 pounds per ton to about 25 pounds per ton of a temporary wet strength resin having aldehydic moieties on a cationic waxy base wherein the ratio of amylopectin to amylose in said temporary wet strength resin is selected to produce temporary wet strength properties and from about 1 pound per ton to about 9 pounds per ton of a cationic nitrogenous softener/debonder chosen from the group consisting of imidazolines, amido amine salts, linear amine amides, tetravalent ammonium salts and mixtures thereof wherein the ratio of temporary wet strength resin to nitrogenous cationic softener/debonder is selected to yield an initial normalized CD wet tensile strength of at least about 40 g/1" strip of tissue paper product, and wherein the ratio of initial wet geometric mean tensile strength to dry geometric mean tensile strength is from at least about 0.20 to about 0.30 and wherein the CD wet tensile strength as measured by the Finch Cup Test 30 minutes after immersion in water is no more than ⅔ the initial value, said tissue paper product in a moistened condition remaining substantially free of pilling when rubbed against a skin-like surface.

56. A flushable, temporary wet strength tissue paper product having a glabrous surface, said paper product comprising a cellulosic web dewatered by overall pressing comprising from about 20% to about 80% hardwood fiber by weight, from about 80% to about 20% softwood fiber by weight; from about 5 pounds per ton to about 25 pounds per ton of a water soluble cationic temporary wet strength resin having aldehydic moieties on a polymeric base, wherein the initial normalized CD wet tensile strength is greater than 35 g/1" with a normalized CD dry tensile strength of from at least about 1100 g/3" strip of tissue paper product and, as measured 30 minutes after immersion in water, a subsequent normalized CD wet tensile strength of less than about ⅔ the initial value, said tissue paper product in a moistened condition remaining substantially free of pilling when rubbed against a skin-like surface.

57. A method of forming a tissue paper product having a glabrous surface and being adapted for use in a dry condition and for use in a manually moistened condition comprising:

providing softwood fibers and hardwood fibers in amounts sufficient to form an overall furnish of from approximately 20% to 80% hardwood fibers by weight and from approximately 80% to 20% softwood fibers by weight, contacting said softwood fibers with a predetermined quantity of a temporary wet strength resin in the range of approximately 5 pounds per ton to 25 pounds per ton of overall furnish, said resin having aldehydic moieties on a cationic waxy starch base;

subsequent to contacting said softwood fibers with said temporary wet strength resin, forming a furnish by combining said hardwood fibers and said softwood fibers;

supplying a predetermined quantity of a cationic nitrogenous softener/debonder chosen from the group consisting of imidazolines, amido amine salts, linear amine amides, tetravalent ammonium salts and mixtures thereof in the range of 1 pound per ton to 9 pounds per ton to said furnish, said cationic nitrogenous softener/debonder contacting said softwood fibers subsequent to contacting said softwood fibers in said furnish with said temporary wet strength resin;

delivering said furnish with said temporary wet strength resin and said softener/debonder to a headbox of a papermaking machine;

forming a cellulosic web from said furnish;

dewatering said web by overall compaction of said web;

forming a tissue paper product having an initial normalized CD wet tensile strength of greater than 25 g/1" as measured using the Finch Cup Test 5 seconds after immersion in water with a normalized dry tensile strength of from at least about 133 g/1" up to no more than about 267 g/1" and, as measured 10 hours after immersion in water, an ultimate normalized CD wet tensile strength of about 15 g/1", said tissue paper product exhibiting a Wet Abrasion Resistance Number of at least about 4.

58. A method of forming a tissue paper product having a glabrous surface and being adapted for use in a dry condition and for use in a manually premoistened condition comprising:

providing softwood fibers and hardwood fibers in amounts sufficient to form an overall furnish comprising from approximately 80% to 20% softwood fibers by weight, and of from approximately 20% to 80% hardwood fibers by weight;

forming a first furnish comprising primarily softwood fibers in a first machine chest;

forming in a machine chest a second furnish comprising hardwood fibers, the percentage of hardwood fibers by weight in said second furnish being greater than the percentage of hardwood fibers in said first furnish;

supplying a predetermined quantity of temporary wet strength resin in the range of approximately 5 pounds per ton to 25 pounds per ton of overall furnish to said first furnish, said temporary wet strength resin having an aldehydic moiety on a cationic waxy base;

supplying a predetermined quantity of cationic nitrogenous softener/debonder chosen from the group consisting of imidazolines, amido amine salts, linear amine amides, tetravalent ammonium salts and mixtures thereof in the range of 1 pound per ton to 9 pounds per ton of overall furnish to said second furnish;

delivering said first and second furnishes with said temporary wet strength resin and said softener/debonder to a headbox of a papermaking machine;

forming a cellulosic web from said furnish;

dewatering said web by overall compaction of said web;

forming a tissue paper product having an initial normalized CD wet tensile strength of greater than 25 g/1" with a normalized dry tensile strength of from at least about 133 g/1" to no more than about 267 g/1", wherein the CD wet tensile strength of said tissue paper product is no more than about ⅔ the initial value as measured 30 minutes after immersion of said tissue paper product in water, said paper product exhibiting a Wet Abrasion Resistance Number of at least about 4.

59. A method of forming a tissue paper product adapted for use in a dry condition and for use in a manually moistened condition comprising:

providing softwood fibers and softwood fibers in amounts sufficient to form an overall furnish of from approximately 80% to 20% softwood fibers by weight and from approximately 20% to 80% hardwood fibers;

forming a first furnish comprising primarily softwood fibers in a first machine chest;

forming a second furnish comprising hardwood fibers in a second machine chest, the percentage of hardwood fibers by weight in said second furnish being greater than the percentage of hardwood fibers in said first furnish;

supplying a predetermined quantity of temporary wet strength resin in the range of approximately 8 pounds per ton to 25 pounds per ton of overall furnish to said first furnish, said wet strength resin having an aldehydic moiety on a cationic waxy base;

supplying a predetermined quantity of cationic nitrogenous softener/debonder chosen from the group consisting of imidazolines, amido amine salts, linear amine amides, tetravalent ammonium salts and mixtures thereof in the range of 1 pound per ton to 9 pounds per ton to said second furnish;

providing a stratified headbox having a plurality of plena;

delivering said first furnish with said temporary wet strength resin to one plenum of said stratified headbox;

delivering said second furnish with said cationic nitrogenous softener/debonder to second plenum of said stratified headbox;

forming a tissue paper product having a glabrous surface and an initial normalized CD wet tensile strength of greater than 35 g/1" as measured by the Finch Cup Method with a normalized dry tensile strength of from at least about 133 g/1" up to about 267 g/1", and, as measured 30 minutes after immersion in water a subsequent CD wet tensile strength of no more than about ⅔ the initial value, said tissue paper product in a moistened condition being substantially free of pilling when rubbed.

60. A flushable, dispersible two-ply tissue paper product, comprising two plies embossed together, each ply having a glabrous surface and being adapted both for use in a dry condition and for use in a premoistened condition, each ply of said tissue product having temporary wet strength, comprising a water soluble organic polymer or monomer having aldehydic units and cationic units, the amount of said water soluble organic polymer or monomer being sufficient to produce a ply having: a normalized CD dry tensile exceeding about 1100 g/3 in; an initial normalized CD wet tensile strength of at least about 50 g/1" strip 5 seconds after immersion as measured by the Finch Cup method and an ultimate normalized CD wet tensile of about 15 g/1" strip as measured 10 hours after immersion, said tissue paper product having been dewatered by overall compaction then embossed, said tissue paper product in a moistened condition exhibiting a Wet Abrasion Resistance Number of at least about 8.

61. The tissue paper product of claim 60 wherein the initial normalized CD wet tensile strength of said product is in excess of at least about 100 g/1" strip when measured 5 seconds after immersion.

62. The tissue paper product of claim 60 wherein the Wet Abrasion Resistance Number of the tissue paper product exceeds 15.

63. The tissue paper product of claim 62, further comprising cationic nitrogenous softener/debonder, wherein the amounts of said cationic nitrogenous softener/debonder and said water soluble organic polymer or monomer are controlled to produce a ratio of cross direction wet tensile strength to cross direction dry tensile strength of over at least about 20%.

64. The tissue paper product of claim 63 wherein the amounts of said cationic nitrogenous softener/debonder and said water soluble organic polymer or monomer are controlled to produce a ratio of cross direction wet tensile strength to cross direction dry tensile strength of over at least about 24%.

65. The tissue paper product of claim 64 wherein the initial normalized CD wet tensile strength of said tissue product is in excess of at least about 125 g/1" strip 5 seconds after immersion.

66. The tissue paper product of claim 64, wherein the amounts of cationic nitrogenous softener/debonder and water soluble organic polymer or monomer are controlled to produce a wet-to-dry GM tensile strength ratio of at least about 20%.

67. The tissue paper product of claim 66, wherein the amounts of said cationic nitrogenous softener/debonder and said water soluble organic polymer or monomer are controlled to produce a ratio of cross direction wet tensile strength to cross direction dry tensile strength of over 18%.

68. A flushable, biodegradable tissue product comprising a cellulosic web dewatered by substantially uniform compaction applied to the entire area of the web and being adapted both for use in a dry condition as well as premoistened shortly before use, said tissue having temporary wet strength, said tissue comprising a water soluble organic polymer or monomer comprising aldehydic units and cationic units, and a cationic nitrogenous softener/debonder, the amounts of said water soluble organic polymer or monomer and said cationic nitrogenous softener/debonder being sufficient to produce an initial normalized CD wet tensile strength of at least about 25 g/1" strip 5 seconds after immersion as measured by the Finch Cup method and an ultimate normalized CD wet tensile of about 15 g/1" strip as measured 10 hours after immersion, said paper product in a moistened condition exhibiting a Wet Abrasion Resistance Number of at least about 4.

69. The tissue of claim 68, wherein the initial normalized CD wet tensile strength of said tissue is in excess of at least about 35 g/1" strip 5 seconds after immersion.

70. The tissue of claim 68 wherein the tensile modulus of the tissue is controlled within the range of less than 32 g/% strain, and the GM MMD of the tissue is controlled to less than 0.23.

71. The tissue of claim 69 wherein the tensile modulus of the tissue is controlled within the range of less than 28 g/% strain, and the GM MMD of the tissue is controlled to less than 0.26.

72. The tissue of claim 71, further comprising cationic nitrogenous softener/debonder, wherein the amounts of cationic nitrogenous softener/debonder and water soluble organic polymer and monomer are controlled to produce a wet-to-dry GM tensile strength ratio of at least about 20%.

73. The tissue of claim 72 wherein processing conditions and the amounts of cationic nitrogenous softener/debonder and water soluble organic polymer or monomer are controlled such that the tensile modulus of the tissue is controlled within the range of less than 26 g/% strain, and the GM MMD of the tissue is controlled to less than 0.185.

74. The tissue of claim 68, further comprising cationic nitrogenous softener/debonder, wherein the amounts of said cationic nitrogenous softener/debonder and said water soluble organic polymer or monomer are controlled to produce a ratio of cross direction wet tensile strength to cross direction dry tensile strength of over 18%.

75. The tissue of claim 68, further comprising cationic nitrogenous softener/debonder, wherein the amounts of said cationic nitrogenous softener/debonder and said water soluble organic polymer or monomer are controlled to produce a ratio of cross direction wet tensile strength to cross direction dry tensile strength of over at least about 20%.

76. The tissue of claim 68, further comprising cationic nitrogenous softener/debonder, wherein the amounts of said cationic nitrogenous softener/debonder and said water soluble organic polymer or monomer are controlled to produce a ratio of cross direction wet tensile strength to cross direction dry tensile strength of over at least about 22%.

77. The tissue of claim 68, further comprising cationic nitrogenous softener/debonder, wherein the amounts of said cationic nitrogenous softener/debonder and said water soluble organic polymer or monomer are controlled to produce a ratio of cross direction wet tensile strength to cross direction dry tensile strength of over at least about 23 to 24%.

78. The tissue of claim 68, further comprising cationic nitrogenous softener/debonder, wherein the amounts of said cationic nitrogenous softener/debonder and said water soluble organic polymer or monomer are controlled to produce a ratio of cross direction wet tensile strength to cross direction dry tensile strength of over at least about 24%.

79. The tissue of claim 68 wherein processing and calendering of said tissue is controlled to produce a GM MMD friction of from about 0.10 to 0.185 and a modulus of from about 23.5 to 10 g/% strain.

80. A temporary wet strength tissue paper product having a glabrous surface, said temporary wet strength tissue paper product comprising from approximately 20% to approximately 80% hardwood fiber by weight, from approximately 80% to 20% softwood fiber by weight, from about 2 pounds per ton to about 30 pounds per ton of a water-soluble temporary wet strength resin having aldehydic moieties on a cationic polymeric base and from about 1 pound per ton to about 10 pounds per ton of a cationic nitrogenous softener/debonder chosen from the group consisting of imidazolines, amido amine salts, linear amido amines, tetravalent ammonium salts and mixtures thereof, wherein the amounts of temporary wet strength resin and nitrogenous cationic softener/debonder are selected to yield an initial normalized CD wet tensile strength of greater than 35 g/1" with a normalized CD dry tensile strength of from at least about 133 g/1" strip of paper product up to about 267 g/1" strip, and a normalized dry tensile modulus of from about 15.5 to about 45.5 g/% strain and, as measured 30 minutes after immersion, an intermediate normalized CD wet tensile strength of less than ⅔ the initial value, said tissue paper product in a moistened condition possessing substantial resistance to pilling and shredding when rubbed against pigskin.

81. A tissue paper product having a glabrous surface and temporary wet strength, which when moistened, exhibits a resistance to pilling when rubbed such that when 4 sheets 2" by 4.5" are saturated, restrained laterally, then rubbed against wet pig-skin under a load of 135 grams within about 2 minutes after immersion, the moistened tissue paper product and pig-skin remain substantially free of pilling and shredding after 4 rubs, said tissue paper product exhibiting an ultimate normalized CD wet tensile of about 15 g/in as measured by the Finch Cup Test 10 hours after immersion in water.

82. A flushable, dispersible biodegradable tissue paper product comprising a wet pressed web comprising a cationic water soluble temporary wet strength resin, said tissue web having a glabrous surface and temporary wet strength, said tissue web when moistened, exhibiting a resistance to pilling when rubbed such that when 4 sheets 2" by 4.5" are saturated, restrained laterally, then rubbed against wet pig-skin under a load of 135 grams within about 2 minutes after immersion, the moistened tissue paper product and pig-skin both remain substantially free of pilling and shredding after 4 rubs.

83. A temporary wet strength tissue paper product having a glabrous surface, said tissue paper product comprising a cellulosic web dewatered by substantially uniform overall compaction, said cellulosic web comprising from about 20% to about 80% hardwood fiber by weight, from about 80% to about 20% softwood fiber by weight; from about 2 pounds per ton to about 30 pounds per ton of a cationic starch having aldehydic moieties, and from about 1 pound per ton up to about 10 pounds per ton of a cationic nitrogenous softener/debonder chosen from the group consisting of imidazolines, amido amine salts, linear amido amines and tetravalent ammonium salts, linear amineamides, imidazolines, and mixtures thereof, wherein the ratio of starch to nitrogenous cationic softener/debonder is selected to yield an initial normalized CD wet tensile strength of greater than 25 g/1" with a normalized CD dry tensile strength of from at least about 133 g/1" strip of tissue paper product up to no more than about 267 g/1" strip, and a GM MMD friction of no more than 0.195 and a tensile modulus of from about 10 to about 25.5 g/% strain and an ultimate normalized CD wet tensile strength of about 15 g/1" as measured 10 hours after immersion in water, said tissue paper product in a moistened condition possessing sufficient wet integrity that when rubbed against a skin-like surface for four strokes less than two minutes after immersion, the skin-like surface remains substantially free of pilling.

84. A temporary wet strength tissue paper product comprising a cellulosic web having a glabrous surface, said web comprising from about 20% to about 80% hardwood fiber by weight, from about 80% to about 20% softwood fiber by weight; from about 5 pounds per ton to about 25 pounds per ton of a starch having an aldehydic moiety on a cationic waxy base wherein the ratio of amylopectin to amylose in said starch results in a starch having temporary wet strength properties and from about 1 pound per ton to about 6 pounds per ton of a cationic nitrogenous softener/debonder chosen from the group consisting of imidazolines, amido amine salts, linear amine amides, tetravalent ammonium salts and mixtures thereof; wherein the amounts of starch and nitrogenous cationic softener/debonder are selected to yield an initial normalized CD wet tensile strength of greater than 50 g/1" as measured by the Finch Cup Test 5 seconds after immersion in water and a normalized CD dry tensile strength of from at least about 1100 g/3" strip of paper product and, as measured 30 minutes after immersion in water, a subsequent CD wet tensile strength of less than ⅔ the initial value, said tissue paper product exhibiting a Wet Abrasion Resistance Number of at least about 15.

85. A temporary wet strength tissue paper product having a glabrous surface comprising from about 20% to about 80% hardwood fiber by weight, from about 80% to about 20% softwood fiber by weight; a temporary wet strength resin comprising starch in an amount of from about 5 pounds per ton to about 15 pounds per ton of paper product, and from about 1 pound per ton to about 6 pounds per ton of a cationic nitrogenous softener/debonder chosen from the group consisting of imidazolines, amido amine salts, linear amine amides, tetravalent ammonium salts and mixtures thereof; said starch having an aldehydic moiety on a cationic waxy base; wherein processing conditions and the amounts of starch and nitrogenous cationic softener/debonder are selected to yield an initial normalized CD wet tensile strength of greater than 35 g/1" and a normalized GM dry tensile strength of from at least about 133 g/1" strip of tissue paper product up to no more than about 267 g/1" strip, and wherein the ratio of initial wet geometric mean tensile strength to dry geometric mean tensile strength is at least about 0.18 and wherein the ultimate CD wet tensile strength, as measured 10 hours after immersion in water, is about 15 g/1", said tissue paper product in a moistened condition remaining substantially free of pilling when rubbed.

86. A temporary wet strength tissue paper product having a glabrous surface, said tissue paper product comprising from about 20% to about 80% hardwood fiber by weight, from about 80% to about 20% softwood fiber by weight; from about 5 pounds per ton to about 15 pounds per ton of temporary wet strength resin starch having aldehydic moieties on a cationic waxy base and from about 1 pound per ton to about 6 pounds per ton of a cationic nitrogenous softener/debonder chosen from the group consisting of imidazolines, amido amine salts, linear amine amides, tetravalent ammonium salts and mixtures thereof wherein the ratio of temporary wet strength resin to nitrogenous cationic softener/debonder is selected to yield an initial normalized CD wet tensile strength of from at least about 45 g/1" strip of tissue paper product as measured by the Finch Cup Test 5 seconds after immersion in water, and wherein the ratio of initial cross direction wet tensile strength to cross direction dry tensile strength is from at least about 0.20 to about 0.30 and wherein the ultimate normalized CD wet tensile strength, as measured 10 hours after immersion in water, is no more than ⅔ the initial value, said tissue paper product in a moistened condition remaining substantially free of pilling when rubbed four strokes over a skinlike surface.

87. A method of forming a tissue paper product having a glabrous surface and being adapted for use in a dry condition and for use in a manually moistened condition comprising:

providing softwood fibers and hardwood fibers in amounts sufficient to form an overall furnish of from approximately 20% to 80% hardwood fibers by weight and from approximately 80% to 20% softwood fibers by weight, contacting said softwood fibers with a predetermined quantity of a temporary wet strength resin comprising starch in the range of approximately 5 pounds per ton to 25 pounds per ton of overall furnish, said starch having aldehydic moieties on a cationic waxy starch base;

subsequent to contacting said softwood fibers with said temporary wet strength resin, forming a furnish by combining said hardwood fibers and said softwood fibers;

supplying a predetermined quantity of a cationic nitrogenous softener/debonder chosen from the group consisting of imidazolines, amido amine salts, linear amine amides, tetravalent ammonium salts and mixtures thereof in the range of 1 pound per ton to 6 pounds per ton to said furnish, said cationic nitrogenous softener/debonder contacting said softwood fibers subsequent to contacting said softwood fibers in said furnish with said starch;

delivering said furnish with said starch and said softener/debonder to a headbox of a papermaking machine;

forming a cellulosic web from said furnish;

dewatering said web by overall compaction of said web;

forming a tissue paper product having an initial normalized CD wet tensile strength of greater than 25 g/1" as measured using the Finch Cup Test 5 seconds after immersion in water with a normalized dry tensile strength of from at least about 133 g/1" up to no more than about 267 g/1" and an ultimate normalized CD wet tensile strength, as measured 10 hours after immersion in water, of about 15 g/1", said tissue paper product exhibiting a Wet Abrasion Resistance Number of at least about 4.

88. A method of forming a tissue paper product having a glabrous surface and being adapted for use in a dry condition and for use in a manually premoistened condition comprising:

providing softwood fibers and hardwood fibers in amounts sufficient to form an overall furnish of from approximately 20% to 80% hardwood fibers by weight and from approximately 80% to 20% softwood fibers by weight, forming a first furnish comprising primarily softwood fibers in a first machine chest;

contacting said softwood fibers in said first furnish with a predetermined quantity of a temporary wet strength resin comprising starch in the range of approximately 5 pounds per ton to 25 pounds per ton of overall furnish, said starch having aldehydic moieties on a cationic waxy base;

subsequent to contacting said softwood fibers with said temporary wet strength resin, forming a second furnish comprising hardwood fibers, the percentage of hardwood fibers in said second furnish being greater than the percentage of hardwood fibers in said first furnish;

supplying a predetermined quantity of a cationic nitrogenous softener/debonder chosen from the group consisting of imidazolines, amido amine salts, linear amine amides, tetravalent ammonium salts and mixtures thereof in the range of 1 pound per ton to 6 pounds per ton of overall furnish to said second furnish, said cationic nitrogenous softener/debonder contacting said softwood fibers subsequent to contacting said softwood fibers in said first furnish with said starch;

delivering said first and second furnishes with said starch and said softener/debonder to a headbox of a papermaking machine;

forming a cellulosic web from said furnish;

dewatering said web by substantially uniform overall compaction of said web;

forming a tissue paper product having a glabrous surface, and an initial normalized CD wet tensile strength of greater than 25 g/1" with a normalized dry tensile strength of from at least about 133 g/1" to no more than about 267 g/1", wherein the ultimate normalized CD wet tensile strength of said tissue paper product is about 15 g/1" after a predetermined period of time, said tissue paper product exhibiting a Wet Abrasion Resistance Nnumber of at least about 4.

89. A method of forming a tissue paper product having a glabrous surface and being adapted for use in a dry condition and for use in a manually moistened condition comprising:

providing softwood fibers and hardwood fibers in amounts sufficient to form an overall furnish of from approximately 80% to 20% softwood fibers by weight and from approximately 20% to 80% hardwood fibers;

forming a first furnish comprising primarily softwood fibers in a first machine chest;

forming a second furnish comprising hardwood fibers in a second machine chest, the percentage of hardwood fibers by weight in said second furnish being greater than the percentage of hardwood fibers in said first furnish;

supplying a predetermined quantity of temporary wet strength resin in the range of approximately 5 pounds per ton to 25 pounds per ton of overall furnish to said first furnish, said temporary wet strength resin comprising starch having aldehydic moieties on a cationic waxy base;

supplying a predetermined quantity of cationic nitrogenous softener/debonder chosen from the group consisting of imidazolines, amido amine salts, linear amine amides, tetravalent ammonium salts and mixtures thereof in the range of 1 pound per ton to 6 pounds per ton to said second furnish;

providing a stratified headbox having a plurality of plena;

delivering said first furnish with said starch to one plenum of the stratified headbox;

delivering said second furnish with said softener/debonder to a second plenum of the stratified headbox;

forming a tissue paper product having an initial normalized CD wet tensile strength of greater than 25 g/1" as measured by the Finch Cup Method 5 seconds after immersion in water with a normalized dry tensile strength of from at least about 133 g/1" up to about 267 g/1", and an ultimate normalized CD wet tensile strength, as measured 10 hours after immersion in water of no more than about 15 g/1", said tissue paper product in a moistened condition being substantially free of pilling when rubbed.

90. The tissue of claim 1 wherein said water soluble temporary wet strength agent comprises organic polymer.

91. The tissue of claim 20 wherein said water soluble temporary wet strength agent comprises an organic polymer.

92. The tissue of claim 60 wherein said water soluble organic polymer or monomer is a polymer.

93. The tissue of claim 60 wherein said water soluble organic polymer or monomer is a monomer.

94. The tissue of claim 68 wherein said water soluble organic polymer or monomer is a polymer.

95. The tissue of claim 68 wherein said water soluble organic polymer or monomer is a monomer.

* * * * *